US011724853B2

(12) United States Patent
Griffis

(10) Patent No.: US 11,724,853 B2
(45) Date of Patent: Aug. 15, 2023

(54) SCENTED ATTACHMENTS FOR BEVERAGE CARTONS

(71) Applicant: SZENT CO., La Jolla, CA (US)

(72) Inventor: Shawn Griffis, La Jolla, CA (US)

(73) Assignee: SZENT CO., La Jolla, CA (US)

( * ) Notice: Subject to any disclaimer, the term of this patent is extended or adjusted under 35 U.S.C. 154(b) by 0 days.

(21) Appl. No.: 17/660,546

(22) Filed: Apr. 25, 2022

(65) Prior Publication Data

US 2023/0057426 A1 Feb. 23, 2023

Related U.S. Application Data

(63) Continuation of application No. 17/065,342, filed on Oct. 7, 2020, now Pat. No. 11,312,528.
(Continued)

(51) Int. Cl.
*B65D 5/44* (2006.01)
*B65D 41/04* (2006.01)
(Continued)

(52) U.S. Cl.
CPC ..... *B65D 5/44* (2013.01); *B65D 5/40* (2013.01); *B65D 5/746* (2013.01); *B65D 41/0407* (2013.01); *B65D 2203/12* (2013.01)

(58) Field of Classification Search
CPC .. B65D 2203/12; B65D 23/00; B65D 51/245; B65D 75/5855; B65D 5/746; A23L 1/22008; B32B 7/12; B32B 27/18
(Continued)

(56) References Cited

U.S. PATENT DOCUMENTS

D25,131 S 2/1896 Fowler, Jr.
D28,746 S 5/1898 Blount
(Continued)

FOREIGN PATENT DOCUMENTS

CN 201694464 U 1/2011
CN 104172723 A 12/2014
(Continued)

OTHER PUBLICATIONS

Etsy. Mini Orange Plastic Soda Bottle Rings/Safety Seals. Mar. 23, 2018 [earliest online date], [site visited Apr. 23, 2018], Available from Internet, <URL:https://etsy.me/2HSzu7f>. (Year: 2018).
(Continued)

*Primary Examiner* — Ernesto A Grano
(74) *Attorney, Agent, or Firm* — Perkins Coie LLP

(57) ABSTRACT

Disclosed are devices, systems and methods for controlling scent delivery by a scented article for beverage containers such as box cartons. In some aspects, a scent delivery system includes a cap removably attachable to a carton container at an opening of the carton container, the cap being moveable between an open position that allows a fluid beverage within the carton container to flow outward and a closed position that prevents the beverage to flow outward; and a scented article that couples to the carton container or the cap and operable to generate a scent capable of stimulating an olfactory sensation of a user including during consumption of the beverage when the cap is in the open position, and when the cap is in closed position, a seal is created by the cap and a base region of the carton container to enclose the scented article and lock in the scent.

8 Claims, 12 Drawing Sheets

Related U.S. Application Data

(60) Provisional application No. 62/911,918, filed on Oct. 7, 2019.

(51) Int. Cl.
*B65D 5/74* (2006.01)
*B65D 5/40* (2006.01)

(58) Field of Classification Search
USPC ..... 220/694
See application file for complete search history.

(56) References Cited

U.S. PATENT DOCUMENTS

D30,094 S 1/1899 Busch
D30,338 S 3/1899 Mann
D31,451 S 8/1899 Norris
D32,681 S 5/1900 Morgenthaler
D44,392 S 7/1912 Whitney
D54,241 S 12/1919 Christian
1,695,822 A 12/1928 Restein
D99,688 S 5/1936 Tomlinson
D101,242 S 9/1936 Poglein
D138,198 S 7/1944 Jackson
D159,985 S 9/1950 Heisey
D172,090 S 5/1954 Pree
2,830,721 A 4/1958 Pinsky et al.
3,043,464 A 3/1959 Cerasari
2,922,454 A 1/1960 Vossloh
D191,418 S 9/1961 Nassour
D206,889 S 2/1967 Benes
D209,311 S 11/1967 Schilling et al.
D212,843 S 12/1968 Hart et al.
3,414,183 A 12/1968 Wilcox
3,432,177 A 3/1969 Leroy
D215,417 S 9/1969 MacDonald
3,464,576 A 9/1969 Rohde
3,590,989 A 7/1971 Wittwer
D221,625 S 8/1971 Kinney et al.
D230,187 S 1/1974 Schultz
D242,200 S 11/1976 Ashton et al.
D243,406 S 2/1977 Mooney et al.
D251,650 S 4/1979 Heller
D252,373 S 7/1979 Eisenrod
D256,003 S 7/1980 Barr
D256,046 S 7/1980 Perrin
D258,202 S 2/1981 Astor et al.
D272,213 S 1/1984 Daenen
4,540,721 A 9/1985 Staller
D285,778 S 9/1986 Smith
D288,902 S 3/1987 Lewis
4,687,203 A 8/1987 Spector
4,717,017 A 1/1988 Sprinkel et al.
D303,915 S 10/1989 Knutson
D305,310 S 1/1990 Flinchbaugh
4,969,570 A 11/1990 Harvey, Sr.
D312,768 S 12/1990 Eastman
4,981,230 A 1/1991 Marshall et al.
D315,309 S 3/1991 Baughman
D317,274 S 6/1991 Redina
D319,035 S 8/1991 Kruse
5,197,620 A 3/1993 Gregory
5,249,676 A 10/1993 Ashcraft et al.
D344,763 S 3/1994 Vitantonio
D348,836 S 7/1994 McCallum et al.
D354,681 S 1/1995 Nolte
D355,708 S 2/1995 Caine
5,388,731 A 2/1995 Mengeu et al.
D358,988 S 6/1995 Nolte
D367,818 S 3/1996 Zana
D372,765 S 8/1996 Sisk
D374,837 S 10/1996 Austin
D383,677 S 9/1997 Darr
5,707,696 A 1/1998 Boxier
D390,111 S 2/1998 Mccarrick
D390,461 S 2/1998 Piselli
D394,824 S 6/1998 Itzkowitz
5,785,240 A 7/1998 Showler
5,806,242 A 9/1998 Park
5,810,184 A 9/1998 Adams et al.
5,858,141 A 1/1999 Repp et al.
5,865,535 A 2/1999 Edwards
5,913,437 A 6/1999 Ma
D412,281 S 7/1999 Lindsay
5,954,247 A 9/1999 Savine
5,957,312 A 9/1999 Adams et al.
D418,414 S 1/2000 Cheng
D422,905 S 4/2000 Walker
6,045,833 A 4/2000 Landau
D424,948 S 5/2000 Ullmo
6,062,441 A 5/2000 Mengeu et al.
6,112,923 A 9/2000 Ma
D438,050 S 2/2001 Huntzinger
D441,650 S 5/2001 Salzburg
D449,556 S 10/2001 Pasquetti
D453,000 S 1/2002 Shinjo
D457,245 S 5/2002 Royal et al.
D457,783 S 5/2002 Bodum
D460,357 S 7/2002 Kras et al.
D465,731 S 11/2002 Brant et al.
6,484,873 B1 11/2002 Pizarro
6,484,896 B2 11/2002 Ma
6,497,337 B1 12/2002 Kehe
D468,492 S 1/2003 Wilhelm
D470,057 S 2/2003 Bowen
6,581,793 B1 6/2003 Racine et al.
D476,893 S 7/2003 Pinnavaia
D477,225 S 7/2003 Pinnavaia
D482,562 S 11/2003 Demers
D482,794 S 11/2003 Whitley
D483,982 S 12/2003 Irvine
6,659,297 B2 12/2003 Gregory et al.
D485,126 S 1/2004 Watson
6,677,397 B1 1/2004 Baranowski et al.
D491,066 S 6/2004 Le Goff
6,766,916 B2 7/2004 Ma
D498,826 S 11/2004 Takahiro et al.
D501,625 S 2/2005 Biggerstaff
6,964,346 B1 11/2005 Taber et al.
D512,914 S 12/2005 Moretti
6,981,602 B2 1/2006 Ma et al.
D515,353 S 2/2006 Martin
D518,717 S 4/2006 German
D518,718 S 4/2006 vonSpreckelsen et al.
D522,368 S 6/2006 Darr et al.
D533,747 S 12/2006 Jin
D533,802 S 12/2006 Thompson et al.
D534,428 S 1/2007 Reed et al.
D534,802 S 1/2007 German
D535,210 S 1/2007 Park
D545,235 S 6/2007 Carter-Smith et al.
D546,225 S 7/2007 Brown
D546,226 S 7/2007 Brown
D546,227 S 7/2007 Brown
D548,092 S 8/2007 Klemm
D553,238 S 10/2007 Haggkvist
D553,254 S 10/2007 Colin et al.
7,284,711 B2 10/2007 Reed et al.
7,306,108 B2 12/2007 Cleevely
D561,595 S 2/2008 Le Bras-Brown
D564,711 S 3/2008 Modi et al.
D565,253 S 3/2008 Modi et al.
D571,214 S 6/2008 Cazatt
D575,154 S 8/2008 Andrews
D576,047 S 9/2008 Reihle
D578,889 S 10/2008 Sadiq et al.
D584,149 S 1/2009 Lohrman et al.
D584,632 S 1/2009 Lloyd
D587,118 S 2/2009 Sadiq et al.
7,484,675 B2 2/2009 Brown
D591,603 S 5/2009 Robin-Prevallee
D592,950 S 5/2009 Kopulos
D593,858 S 6/2009 Kubicek et al.
D595,581 S 7/2009 Brunson

(56) References Cited

U.S. PATENT DOCUMENTS

D598,238 S 8/2009 Durdon et al.
D600,115 S 9/2009 Trayser
D601,309 S 9/2009 Babal
D602,651 S 10/2009 Modi et al.
RE41,055 E 12/2009 Choke-arpornchai
D606,864 S 12/2009 Robinson
D610,011 S 2/2010 De Pieretti
D611,814 S 3/2010 Marotti et al.
D611,822 S 3/2010 Rajani
D614,247 S 4/2010 Clausen
D615,816 S 5/2010 Joy et al.
D617,426 S 6/2010 Zeyfang
D618,500 S 6/2010 Hardaway
7,748,557 B2 7/2010 Robinson
D621,266 S 8/2010 Smith
D622,600 S 8/2010 Bradfield
D623,056 S 9/2010 Sessa
D623,460 S 9/2010 Krasner
7,798,320 B2 9/2010 Pham
D625,183 S 10/2010 Bartsch
D633,386 S 3/2011 Taber et al.
D633,387 S 3/2011 Gatto
D634,199 S 3/2011 Taber et al.
D634,200 S 3/2011 Taber et al.
D635,352 S 4/2011 Himley et al.
D635,399 S 4/2011 DelVecchio
D637,448 S 5/2011 Cheng
D643,729 S 8/2011 Lovelace, Jr.
D643,912 S 8/2011 Bowman
D646,568 S 10/2011 Heidel et al.
D646,600 S 10/2011 Minkkinen et al.
D650,677 S 12/2011 Wurster et al.
D654,752 S 2/2012 Krasner
D655,167 S 3/2012 Weber-Trinkfass et al.
D657,675 S 4/2012 Averill
D662,767 S 7/2012 Hotell et al.
D666,461 S 9/2012 Siegel
D669,781 S 10/2012 Fields
D671,406 S 11/2012 Sawicki et al.
D678,989 S 3/2013 Zerrer
D679,598 S 4/2013 Miceli
D679,999 S 4/2013 Miceli
D684,065 S 6/2013 Wiseman
D684,082 S 6/2013 Alvarez et al.
D684,274 S 6/2013 Hosoya et al.
D686,075 S 7/2013 Guerin et al.
D686,081 S 7/2013 Colangelo
D686,101 S 7/2013 Dailey
8,474,637 B2 7/2013 Zhang et al.
D689,332 S 9/2013 Krasner
D689,789 S 9/2013 Hardy
D690,218 S 9/2013 Cobbett
D691,885 S 10/2013 Potts
D693,645 S 11/2013 Keyes
D694,107 S 11/2013 Didio
D696,751 S 12/2013 Beagen, Jr.
D696,952 S 1/2014 Sawicki et al.
D697,805 S 1/2014 You
8,672,158 B2 3/2014 Taber
8,708,189 B2 4/2014 Reitzig
D704,088 S 5/2014 Farris
D706,908 S 6/2014 Knapp
D706,909 S 6/2014 van de Klippe et al.
D715,092 S 10/2014 Thun et al.
8,881,988 B2 11/2014 Miceli
D723,919 S 3/2015 Taber et al.
D724,386 S 3/2015 Royer et al.
D725,953 S 4/2015 Gamelli et al.
D730,734 S 6/2015 Rapparini
D733,604 S 7/2015 Tan et al.
D734,670 S 7/2015 Griffis
9,108,763 B2 8/2015 Landau
D743,255 S 11/2015 Niggemyer
D743,513 S 11/2015 Yamagishi et al.
D744,846 S 12/2015 Koop et al.
D752,378 S 3/2016 Wang
D752,975 S 4/2016 Gatto
D753,490 S 4/2016 O'Donahue
9,302,830 B2 4/2016 Ramsey et al.
D756,228 S 5/2016 Premkumar
D758,195 S 6/2016 Braz et al.
D762,115 S 7/2016 Corvaglia et al.
D766,716 S 9/2016 Logel et al.
9,452,859 B2 9/2016 Franic
D776,529 S 1/2017 Torrison et al.
D778,199 S 2/2017 Amfitheatrof
D779,941 S 2/2017 Koga
D783,406 S 4/2017 Melrose
D783,607 S 4/2017 Lee et al.
D784,182 S 4/2017 Baker
D785,144 S 4/2017 Kitagawa
D788,587 S 6/2017 Clemence
D789,232 S 6/2017 Baker
D791,591 S 7/2017 Berge
D792,219 S 7/2017 Bueno Nunez
D793,237 S 8/2017 Vitale Rolla
D795,021 S 8/2017 Lindloff
D796,901 S 9/2017 Pisarevsky
D799,900 S 10/2017 Santos et al.
D799,963 S 10/2017 Akiyama
9,777,244 B2 10/2017 Lei
9,801,969 B2 10/2017 Griffis
D804,305 S 12/2017 White
D804,306 S 12/2017 Simons
D804,900 S 12/2017 Choe
D804,906 S 12/2017 Diener et al.
D807,173 S 1/2018 Cooper et al.
D807,749 S 1/2018 Beaver
D808,810 S 1/2018 Rajesh
D809,923 S 2/2018 Marantis
D810,504 S 2/2018 Goodwin
D815,951 S 4/2018 Solovy
D817,096 S 5/2018 Kauss et al.
9,957,076 B2 5/2018 Tung
D820,679 S 6/2018 Ali
D821,150 S 6/2018 Liao
D824,257 S 7/2018 Wood et al.
D824,264 S 7/2018 Toribio
D824,763 S 8/2018 Suess et al.
D826,047 S 8/2018 Griffis
D827,435 S 9/2018 Griffis
D828,088 S 9/2018 Furneaux et al.
D829,101 S 9/2018 Spivey et al.
D830,773 S 10/2018 Jacobsen
D832,105 S 10/2018 Clemence
D832,130 S 10/2018 Bostic
10,086,104 B2 10/2018 Griffis
D832,734 S 11/2018 Warren
D833,293 S 11/2018 Lin
D836,389 S 12/2018 Ante et al.
D837,052 S 1/2019 Rapparini
D837,054 S 1/2019 Mallahan, III
D838,171 S 1/2019 Wood et al.
10,189,611 B2 1/2019 Cox
D839,673 S 2/2019 Meyers
D842,030 S 3/2019 Meyers
D846,096 S 4/2019 Copeland
D846,097 S 4/2019 Copeland
D846,098 S 4/2019 Copeland
10,252,842 B2 4/2019 Miceli
D848,844 S 5/2019 Byron et al.
D851,996 S 6/2019 Umholtz
D852,335 S 6/2019 Copeland
D852,336 S 6/2019 Copeland
10,328,172 B2 6/2019 Griffis
D844,433 S 7/2019 Hall et al.
D852,634 S 7/2019 Balletta et al.
D852,935 S 7/2019 Copeland
D855,464 S 8/2019 Hall et al.
D857,859 S 8/2019 Copeland
D858,903 S 9/2019 Jennings
D873,142 S 1/2020 Jones
D875,525 S 2/2020 Griffis
D876,236 S 2/2020 Griffis

(56) References Cited

U.S. PATENT DOCUMENTS

| | | | |
|---|---|---|---|
| D884,479 | S | 5/2020 | Hall |
| D884,540 | S | 5/2020 | Tse |
| D885,962 | S | 6/2020 | Jones |
| D885,963 | S | 6/2020 | Riviere |
| D891,287 | S | 7/2020 | Fort, Jr. |
| D891,967 | S | 8/2020 | Fort, Jr. |
| D891,970 | S | 8/2020 | Fort, Jr. |
| D891,971 | S | 8/2020 | Fort, Jr. |
| 10,744,223 | B2 | 8/2020 | Griffis |
| D895,777 | S | 9/2020 | Chase |
| D896,679 | S | 9/2020 | Lachyani Abiri |
| D901,306 | S | 11/2020 | Clark |
| D905,559 | S | 12/2020 | Ungrady |
| 10,864,293 | B2 | 12/2020 | Griffis |
| D909,186 | S | 2/2021 | Wang |
| D911,208 | S | 2/2021 | Tysander |
| D911,846 | S | 3/2021 | Van Den Heijkant |
| D913,140 | S | 3/2021 | Grace |
| D917,963 | S | 5/2021 | Ozturk |
| D919,469 | S | 5/2021 | Fort, Jr. |
| D931,105 | S | 9/2021 | Griffis |
| D931,688 | S | 9/2021 | Wang |
| D934,102 | S | 10/2021 | Barnes |
| D939,352 | S | 12/2021 | Kelley |
| D943,449 | S | 2/2022 | Yang |
| D944,679 | S | 3/2022 | Lopez |
| D946,449 | S | 3/2022 | Mclear |
| D947,056 | S | 3/2022 | Choo |
| D947,707 | S | 4/2022 | Mclear |
| D950,384 | S | 5/2022 | Griffis |
| D966,105 | S | 10/2022 | Cronk |
| D966,892 | S | 10/2022 | Comehl |
| 2001/0027957 | A1 | 10/2001 | Kano et al. |
| 2002/0139093 | A1 | 10/2002 | Landau |
| 2002/0158037 | A1 | 10/2002 | Kano et al. |
| 2002/0190023 | A1 | 12/2002 | Landau |
| 2003/0132244 | A1 | 7/2003 | Birkmayer et al. |
| 2004/0018278 | A1 | 1/2004 | Popplewell |
| 2004/0020890 | A1 | 2/2004 | Tan et al. |
| 2004/0029750 | A1 | 2/2004 | Schudel et al. |
| 2004/0262174 | A1 | 12/2004 | Buesching et al. |
| 2005/0142084 | A1 | 6/2005 | Ganguly |
| 2005/0274819 | A1 | 12/2005 | Reed et al. |
| 2006/0144912 | A1 | 7/2006 | Franic |
| 2006/0255002 | A1 | 11/2006 | Takamatsu et al. |
| 2007/0051690 | A1 | 3/2007 | Hidding |
| 2007/0114142 | A1 | 5/2007 | Sine et al. |
| 2008/0067142 | A1 | 3/2008 | Druitt |
| 2008/0149586 | A1 | 6/2008 | Loughrin et al. |
| 2008/0173611 | A1 | 7/2008 | Neputy et al. |
| 2008/0245757 | A1 | 10/2008 | Durand |
| 2009/0045158 | A1 | 2/2009 | Suriol |
| 2009/0078786 | A1 | 3/2009 | Slade |
| 2010/0084362 | A1 | 4/2010 | Letchinger et al. |
| 2011/0253584 | A1 | 10/2011 | Duan |
| 2011/0290755 | A1 | 12/2011 | Taber et al. |
| 2012/0006909 | A1 | 1/2012 | Zhang et al. |
| 2012/0175016 | A1 | 7/2012 | Lopez et al. |
| 2013/0015193 | A1 | 1/2013 | Lien et al. |
| 2013/0043245 | A1 | 2/2013 | Griffis |
| 2013/0119056 | A1 | 5/2013 | Jacobson et al. |
| 2013/0205718 | A1 | 8/2013 | Kapolas |
| 2013/0221007 | A1 | 8/2013 | Jung et al. |
| 2013/0313218 | A1 | 11/2013 | Cox et al. |
| 2014/0158660 | A1 | 6/2014 | Wood et al. |
| 2014/0263335 | A1 | 9/2014 | Taber et al. |
| 2015/0027974 | A1 | 1/2015 | Niec |
| 2015/0076030 | A1 | 3/2015 | Smith |
| 2015/0102033 | A1 | 4/2015 | Banovie |
| 2015/0305349 | A1 | 10/2015 | Johnson et al. |
| 2015/0329247 | A1 | 11/2015 | Lou |
| 2015/0366250 | A1 | 12/2015 | Landau |
| 2015/0375906 | A1 | 12/2015 | Vieker |
| 2016/0106149 | A1 | 4/2016 | Potter et al. |
| 2016/0122066 | A1 | 5/2016 | DiBiasio |
| 2017/0081095 | A1 | 3/2017 | McPherson et al. |
| 2017/0239382 | A1 | 8/2017 | Griffis |
| 2017/0240325 | A1 | 8/2017 | Seelhofer |
| 2017/0275075 | A1 | 9/2017 | Bamonte et al. |
| 2017/0326263 | A1 | 11/2017 | Griffis |
| 2018/0043047 | A1 | 2/2018 | Griffis |
| 2018/0079552 | A1 | 3/2018 | Ayeni |
| 2018/0127159 | A1 | 5/2018 | Cunningham |
| 2018/0141730 | A1 | 5/2018 | Rognard |
| 2018/0201414 | A1 | 7/2018 | Rouquette |
| 2019/0009953 | A1 | 1/2019 | Edie et al. |
| 2019/0062007 | A1 | 2/2019 | Kim |
| 2019/0084728 | A1 | 3/2019 | Bonfoey et al. |
| 2019/0091363 | A1 | 3/2019 | Griffis |
| 2019/0118989 | A1 | 4/2019 | Kim |
| 2019/0224359 | A1 | 7/2019 | Griffis |
| 2019/0367230 | A1 | 12/2019 | Griffis |

FOREIGN PATENT DOCUMENTS

| | | | |
|---|---|---|---|
| CN | 104495736 | A | 4/2015 |
| DE | 102006038257 | A1 | 2/2008 |
| DE | 102009020524 | A1 | 11/2010 |
| DE | 202017001221 | U1 | 7/2017 |
| GB | 5000214 | | 10/2015 |
| GB | 2569075 | | 6/2019 |
| JP | 06505412 | H | 6/1994 |
| JP | 2000085777 | A | 3/2000 |
| JP | 2006-168788 | A | 6/2006 |
| WO | 2010068731 | | 6/2010 |
| WO | 2010128149 | A1 | 11/2010 |
| WO | 2012006328 | A1 | 1/2012 |
| WO | 2013105066 | A1 | 7/2013 |
| WO | 2018085580 | | 5/2018 |
| WO | 2018203993 | | 11/2018 |
| WO | 2019232431 | | 12/2019 |

OTHER PUBLICATIONS

First Action Interview Pilot Program Pre-Interview Communication for U.S. Appl. No. 15/782,720, dated Apr. 2, 2018 (6 pages).

Flavour Bottle: The world's first flavored bottle, available at https://www.kickstarter.com/projects/flavourtechnologies/flavour-bottle-the-worlds-first-flavored-bottle/description.

Forever Gifts. Beveled Edge Black Tungsten Wedding Band. Apr. 26, 2017 [earliest online date], [site visited Apr. 26, 2018], Available from Internet, <URL:https://www.forevergifts.com/beveled-edge-black-tungsten-wedding-band-free-engraving/>. (Year: 2017).

High-Tech Cocktail Glass Lets You Experience Plain Water as the Perfect Cocktail, Oddity Central, available at http://www.odditycentral.com/technology/high-tech-cocktail-glass-lets-you-experience-plain-water-as-the-perfect-cocktail.html, Nov. 20, 2017.

International Search Report and Written Opinion for International Application No. PCT/US18/24630, dated Apr. 23, 2018 (7 pages).

Non-Final Office Action for U.S. Appl. No. 15/663,534, dated Apr. 2, 2018 (26 pages).

Non-Final Office Action for U.S. Appl. No. 29/598,882, dated May 1, 2018 (29 pages).

Non-Final Office Action for U.S. Appl. No. 29/598,879, dated May 1, 2018 (26 pages).

The New York Times. Mystery in Sochi Doping Case Lies With Tamper-Proof Bottle by Rebecca R. Ruiz. May 13, 2016 [earliest online date], [site visited Apr. 23, 2018], Available from Internet, <URL:https://www.nytimes.com/2016/05/14/sports/russia-doping-bottles-olympics-2014.html>. (Year: 2016).

Examination Report received for European Union Design Application No. 005826559; dated Nov. 28, 2018 (2 pages).

First Examiner's Report received for Canadian Application No. 177508; dated Jul. 23, 2018 (3 pages).

Non-Final Office Action received for U.S. Appl. No. 15/663,534, dated Aug. 16, 2018 (26 pages).

First Examiner's Report received for Australian Application No. 2018202261; dated Aug. 30, 2018 (5 pages).

Office Action for German Application No. 10 2018 003 090.4, dated Jan. 15, 2019 (8 pages).

(56) References Cited

OTHER PUBLICATIONS

Examiner's Report received for Canadian Application No. 2999583; dated Jan. 30, 2019 (3 pages).
Final Office Action received for U.S. Appl. No. 15/663,534; dated Feb. 13, 2019 (19 pages).
Non-Final Office Action received for U.S. Appl. No. 29/599,447, dated Mar. 28, 2019 (10 pages).
Szent Water: Announced Nov. 7, 2018 [online]. Site visited [Mar. 22, 2019], Available from internet URL: https:// www.amazon.com/ SZE NT-Water-Passionfruit-Ounce-Pack/dp/B07G8 LH B F2/ref= cm_cr _arp d_product_top?ie_=UTF8&th = 1.
Notice of Allowance Received for U.S. Appl. No. 15/663,534, dated May 3, 2019.
Notification to Grant Patent Right for Design and Go through Formalities of Registration Received for Chinese Application No. 201830652933.8 dated Jul. 16, 2019.
International Search Report and Written Opinion for International Application No. PCT/US19/24708, dated Jun. 24, 2019 (9 pages).
Notice of Acceptance for Patent Application Received for Australia Application No. 2018202261, dated May 30, 2019.
Amazon. Szent Water Passionfruit Ounce Pack. Review by Brett Conway on Nov. 9, 2018. hhttps://www.amazon.com/SZENT-Water-Passionfruit-Ounce-Pack/dp/B07G8LHBF2?th=1(Year: 2018).
Amazon. Oxford Ivy—Men's 14K White Gold 6MM Comfort Fit Beveled Edge Wedding Band Sep. 30, 2016. https://www.amazon.com/ White-Comfort-Beveled-Wedding-Available/dp/B01 LYD52N4 (Year: 2016).
Notice of Allowance Received for Canadian Application No. 2999583, dated Aug. 7, 2019.
Non-Final Office Action received for U.S. Appl. No. 16/368,796 dated Sep. 16, 2019.
International Application No. PCT/US19/34990 International Search Report and Written Opinion, dated Oct. 3, 2019.
Final Office Action received for U.S. Appl. No. 29/599,447, dated Oct. 10, 2019 (26 pages).
Examination Report received for GB 1904947.7; dated Sep. 3, 2019 (2 pages).
Examination Report received for Canadian Design Application No. 184681; dated Oct. 8, 2019 (44 pages).
Final Office Action received for U.S. Appl. No. 29/599,450; dated Dec. 11, 2019 (17 pages).
Non-Final Office Action received for U.S. Appl. No. 29/650,568; dated Dec. 19, 2019 (7 pages).
Non-Final Office Action received for U.S. Appl. No. 29/650,571; dated Dec. 19, 2019 (10 pages).
Canadian Application No. 2,999,583 Examination Report dated Mar. 13, 2020.
U.S. Appl. No. 16/368,796 Notice of Allowance dated Apr. 8, 2020. (8 pages).
European Application No. 18794704.9-1104 Extended European Search Report dated Jul. 9, 2020, pp. 1-9.
International Application No. PCT/US2019/024708, International Preliminary Report on Patentability dated Oct. 8, 2020.
GB Application No. GB2002178.8 Search and Examination Report dated Aug. 19, 2020, pp. 1-5.
Ratti Report. A Brand New Kind of Water is Agencyless. Oct. 19, 2018. https://ratti-report.com/industry-food-bev/a-brand-new-kind-of-water-is-agencyless/ (pages 1-3).
Griffis, Shawn. U.S. Appl. No. 29/707,365, Non-Final Office Action dated Oct. 12, 2020, pp. 1-7.
Griffis, Shawn. U.S. Appl. No. 16/428,737 Non-Final Office Action dated Nov. 27, 2020 (pp. 1-7).
Chinese Application No. 201911118814.4, First Office Action dated Nov. 3, 2020, pp. 1-6.
U.S. Appl. No. 29/598,879 Notice of Allowance dated Apr. 26, 2021, pp. 1-5.
U.S. Appl. No. 29/647,898 Restriction Requirement dated Apr. 26, 2021, pp. 1-6.
U.S. Appl. No. 29/647,895 Restriction Requirement dated Apr. 26, 2021, pp. 1-5.
Canadian Patent Application No. 2999583 Notice of Allowance dated Apr. 20, 2021, pp. 1-14.
U.S. Appl. No. 29/647,905 Non-Final Office Action dated Jun. 30, 2021, pp. 1-9.
SKS Bottle & Packaging Tamper Evident Containers, announced Aug. 18, 2011, [online], site visited Jun. 26, 2021. Available from Internet, URL: http://www.sks-bottle.com (Year: 2011).
U.S. Appl. No. 29/647,895 Non-Final Office Action dated Sep. 2, 2021, pp. 1-7.
U.S. Appl. No. 29/647,898 Non-Final Office Action dated Sep. 2, 2021, pp. 1-11.
U.S. Appl. No. 17/065,342 Non-Final Office Action dated Sep. 7, 2021, pp. 1-9.
U.S. Appl. No. 16/944,046 Non-Final Office Action dated Sep. 21, 2021, pp. 1-10.
European Application No. 19776680.1 Extended European Search Report dated Nov. 22, 2021, pp. 1-7.
Japanese Application No. 2019-089940 dated Jan. 28, 2022, pp. 1-11.
J. Gregory Pickett, U.S. Appl. No. 17/396,121, Notice of Allowance dated Nov. 23, 2022, pp. 1-8.
Ernesto A. Grano, U.S. Appl. No. 17/806,623, Non-Final Office Action dated Mar. 13, 2023, pp. 1-19.
Darcey E. Gottschalk, Design U.S. Appl. No. 29/808,087, Non-Final Office Action dated Nov. 22, 2022, pp. 1-6.
Well + Good. Boosted Waters are Here to Pep You up, Chill You Out, and Hydrate You to the Fullest. Oct. 23, 2018. https:// www.wellandgood.com/hydration-extra-benefits/ (Year: 2018).

SCENTED ATTACHMENTS FOR BEVERAGE CARTONS

CROSS-REFERENCE TO RELATED APPLICATIONS

This patent document claims priority to and the benefits of U.S. patent application Ser. No. 17/065,342, titled "SCENTED ATTACHMENTS FOR BEVERAGE CARTONS" and filed Oct. 7, 2020, which claims priority to and the benefits of U.S. Provisional Patent Application No. 62/911,918, titled "SCENTED ATTACHMENTS FOR BEVERAGE CARTONS" and filed on Oct. 7, 2019. The entire content of the aforementioned patent applications are incorporated by reference as part of the disclosure of this patent document.

TECHNICAL FIELD

This patent document relates to techniques, devices and systems for controlling scent delivery by scented articles in beverage containers, such as paper-based cartons, to enhance a user's sense of smell and/or taste while consuming the beverage.

BACKGROUND

Fragrance or aroma compounds have been used since antiquity to freshen air and cover odors. One early example includes incense, an aromatic material that forms a fragrant smoke when burned, which is believed to have been used by the ancient Egyptians, Babylonians, and other ancient peoples thousands of years ago. Perfumes were developed over time, having various concentrations of aromatic compounds in a solvent, such as an alcohol. For example, a cologne typically has 3-8% aromatic compound(s) in solvent, whereas an eau de toilette has 5-15% aromatic compound(s) in solvent. By the middle of the twentieth century, fragrance compounds were manufactured into aerosol sprays for air freshener and deodorant products; and decades later, scented materials were developed in products like scented candles.

The nasal cavity has specialized sensory cells that mediate olfaction. The main olfactory system of humans and animals detects volatile chemicals, and the accessory olfactory system detects fluid-phase chemicals. Olfaction like taste is a form of chemoreception. The chemicals that activate the olfactory system, generally at very low concentrations, are called odorants. Accordingly, there is a commonality between the perception of smell and the perception of taste. In fact, in certain instances, the sense of smell may supplement and/or otherwise enhance the sense of taste. For instance, it is well known that maladies affecting the sense of smell adversely affect the sense of taste. As taste plays an important role in one's motivation for consuming a food or drink article, there is an interest in the art for agents that enhance the perception of taste of food and drink articles.

SUMMARY

Disclosed are techniques, devices and systems for controlling scent delivery and/or preserving a scent from a scented article incorporated in a beverage container, such as paper-based cartons referred to as "box cartons" or "box carton containers." In some aspects, the disclosed techniques, devices and systems provide improvements for applying such scented articles to a wide range of beverage cartons having different structures in ways that preserve the scented articles' ability to deliver and preserve their scent across multiple uses.

In some aspects, a scent delivery system for a beverage contained in a box carton includes a box carton container to contain a fluid beverage, the box carton container including a main body region and an upper body region, the upper body region including a spout having an opening into the inside of the box carton container; a cap attachable to the spout of the box carton container to cover the opening, the cap operable to move, reversibly, between (i) a closed position that prevents the beverage contained within the box carton container to flow outward from the box carton container while the cap is attached to the box carton container and (ii) an open position that allows the beverage within the box carton container to flow outward while the cap is unattached to the box carton container; and a scented article coupled to the box carton container and operable to generate a scent capable of stimulating an olfactory sensation of a user including during consumption of the beverage when the cap is in the open position, wherein, when the cap is attached to the spout in the closed position, an interior surface of the cap and an external surface of the box carton container create a contact seal that encloses the scented article in a space within and locks in the scent.

In some aspects, a scent delivery system for a beverage contained in a box carton includes a box carton container to contain a fluid beverage, the box carton container including a main body region and an upper body region, the upper body region including a spout having an opening into the inside of the box carton container; a cap attachable to the spout of the box carton container to cover the opening, the cap operable to move, reversibly, between (i) a closed position that prevents the beverage contained within the box carton container to flow outward from the box carton container while the cap is attached to the box carton container and (ii) an open position that allows the beverage within the box carton container to flow outward while the cap is unattached to the box carton container; and a scented article coupled to the cap and operable to generate a scent capable of stimulating an olfactory sensation of a user including during consumption of the beverage when the cap is in the open position, wherein, when the cap is attached to the spout in the closed position, an interior surface of the cap and an external surface of the box carton container create a contact seal that encloses the scented article in a space within and locks in the scent.

The subject matter described in this patent document can be implemented in ways that provide one or more of the following features.

DETAILED DESCRIPTION

Figure 1A:
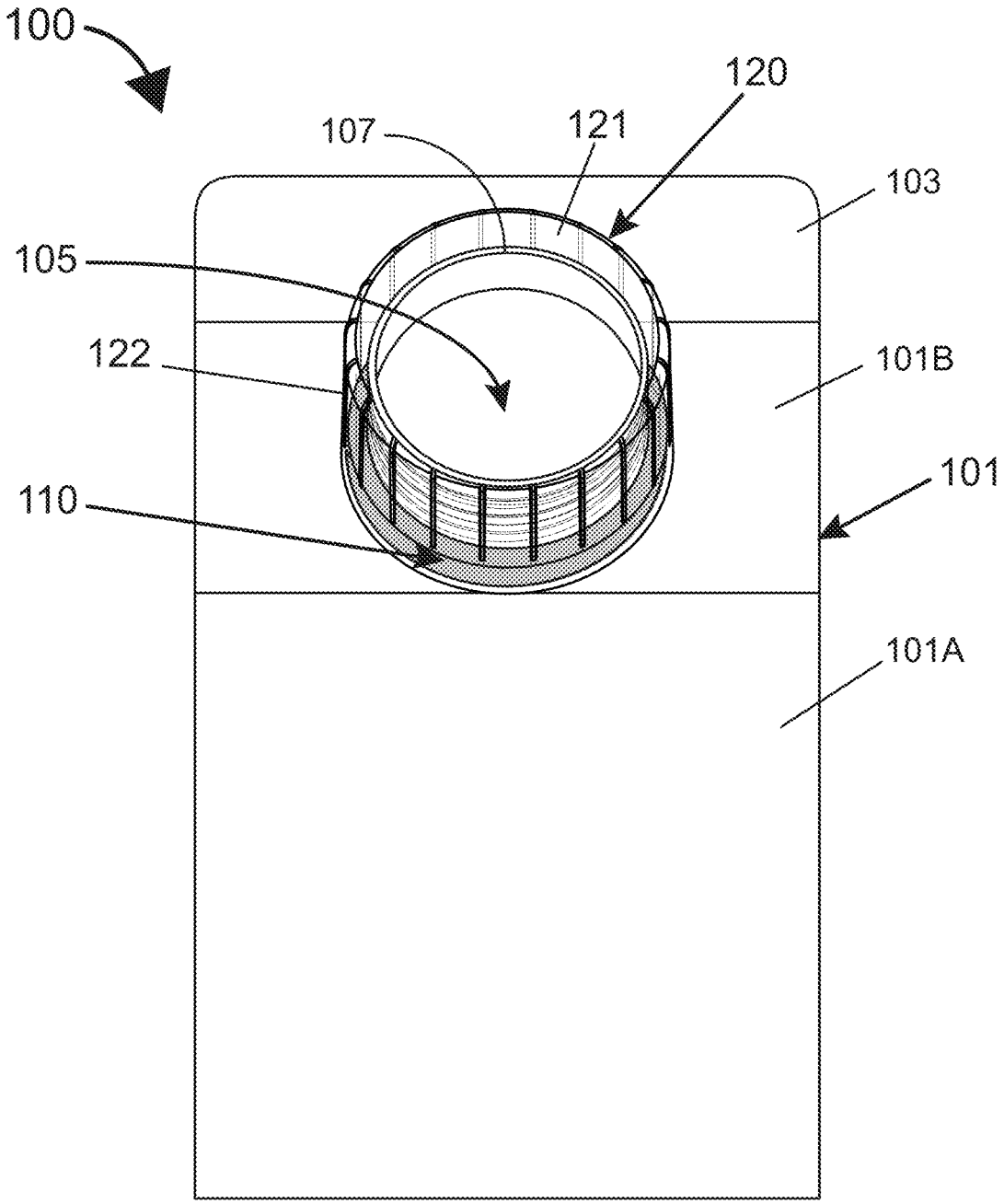
FIGS. 1A-1C show diagrams of example embodiments of a scented system that can be applied to a carton container (a "box carton") having a cap-covered opening for securing a scented article in accordance with the disclosed technology.

For humans, mammals and other living things, the olfactory system detects airborne substances, e.g., volatile chemicals, and provides the living organism with a sense of smell. Olfaction, like taste, is a form of chemoreception. Accordingly, there is a commonality between the perception of smell and the perception of taste. In certain instances, the sense of smell may supplement and/or otherwise enhance the sense of taste, and, for example, maladies affecting the sense of smell adversely affect the sense of taste.

Taste plays an important role in one's motivation for consuming food or drink. As such, food science has spent decades formulating new processed foods and drinks having agents that enhance the perception of taste of food and drink articles. However, more and more studies are showing adverse health effects for some processed foods, which can be due to additives that were used to enhance perception of taste.

Scent-based technologies, such as scented materials and articles, can be used to augment the characteristics of the material or article to affect a person's sense of smell, and thereby sense of taste. For example, a scented material or article may include a chemical agent, such as a fragrance or aroma compound, that stimulates a chemoreceptor of the olfactory system of the subject or otherwise stimulates sense of smell and/or taste of a subject. One example of scent-based technologies includes scented articles that attach or are included as part of a drinking bottle system, in which the scented article provides a pleasing odorant to a user that stimulates a corresponding chemoreceptor of the user's olfactory system to enhance the user's sense of smell and/or taste of a drinkable fluid in the bottle. For example, the scented article can be a lime-scented ring that attaches to the bottle around the bottle opening so that, as the user drinks the beverage within the bottle, such as water, the user experiences a lime-taste to the water from the lime scent that emanates from the scented article while drinking.

Some examples of the scented articles for augmenting a user's perception of taste through smell are described in U.S. Pat. No. 9,801,969B2 titled "SCENTED ATTACHMENT FOR CONTAINERS" and U.S. Patent Publication No. 2019/0367230A1 titled "SCENT DELIVERY AND PRESERVATION SYSTEMS AND METHODS FOR BEVERAGE CONTAINERS," which are both incorporated by reference herein as part of the this patent document for all purposes.

Yet, there are a variety of beverage containers that have different container structures than a typical bottle and that serves different purposes for the user. For example, paper-based cartons (referred to herein as "box cartons" or "box carton containers") are typically used for beverage subject to spoiling when not refrigerated or from light, such as milk, juice, or other beverages. Box cartons, such as milk containers, are typically made from paperboard with an inner and outer coating of a waterproof plastic, such as polyethylene, for sealing the liquid. The paperboard may be formed of a wood pulp, which can be a blend of softwood (e.g., pine) and hardwood (e.g., oaks), e.g., 40% softwood and 60% hardwood. For example, softwood can provide longer fibers for strength to the paperboard, and hardwood can provide shorter fibers for easier manufacturing purposes. Some box cartons may include a thin metallic layer, such as aluminum, for providing a barrier against light and oxygen.

For each type of drinking container, whether a bottle, cup with a lid, box carton, or other, each type includes its own design that brings a unique set of challenges for effectively and consistently providing a scented article to preserve and deliver the desired scent when a user wishes to consume the beverage from the particular drinking container, such that the user's drinking experience is augmented by a virtual sense of taste perception due to the delivered scent. Some problems are shared by both the structural constraints of the drinking container design and that of the scented article's size, scent concentration, and position configurations with respect to the drinking container. Many conventional scented articles for affecting use of a beverage or other products have failed to effectively augment the user's experience with that product for such reasons.

Disclosed are techniques, devices and systems for controlling scent delivery and/or preserving a scent from a scented article incorporated in a beverage container, such as a box container including gable top and non-gable top box containers. In some aspects, the disclosed techniques, devices and systems provide improvements for applying such scented articles to a wide range of different beverage containers in ways that preserve the scented articles' ability to deliver and preserve a consistent scent experience across multiple uses.

Example embodiments of scent delivery systems and methods in accordance with the present technology are described below.

Figure 1B:
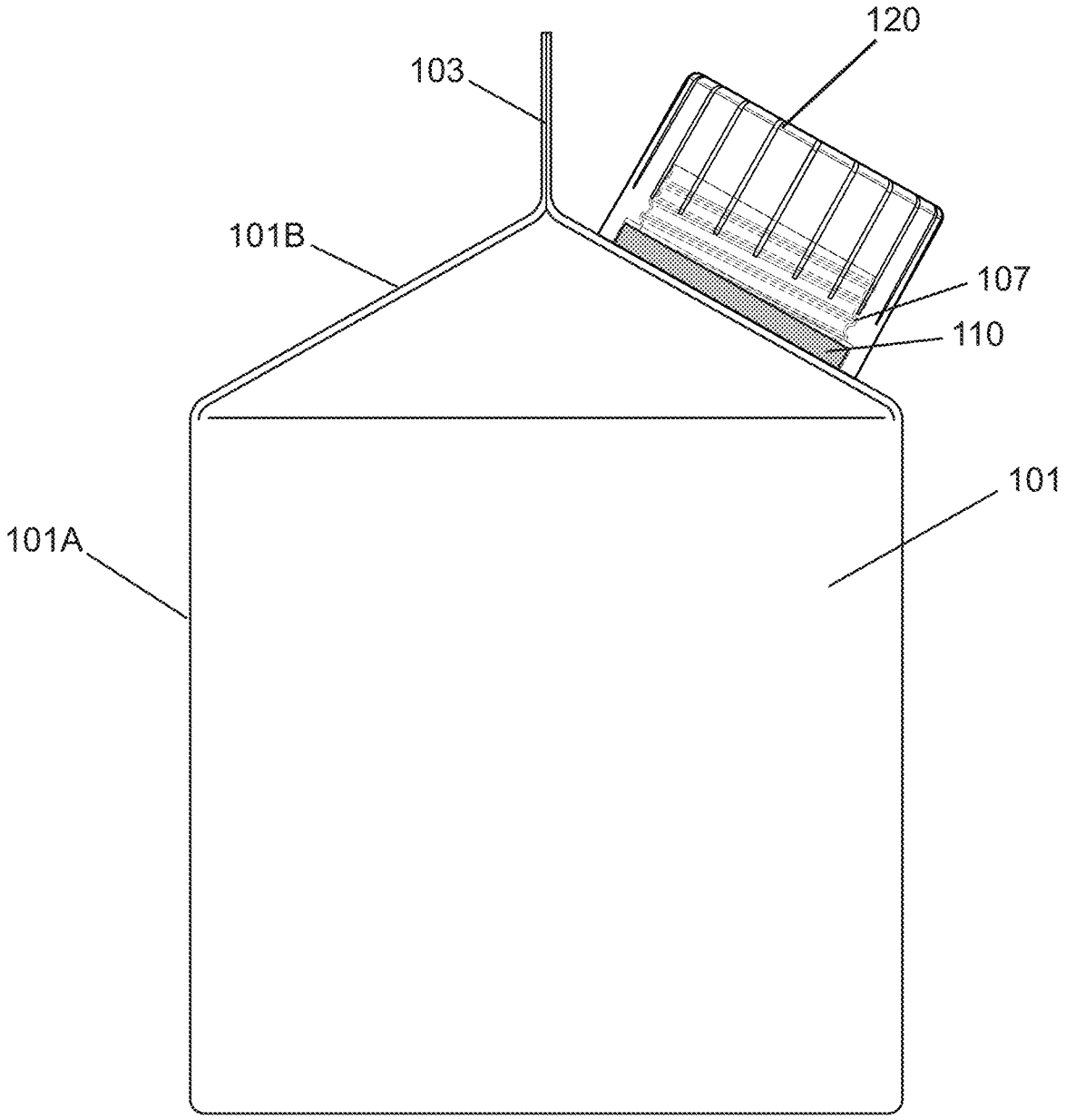
Figure 1C:
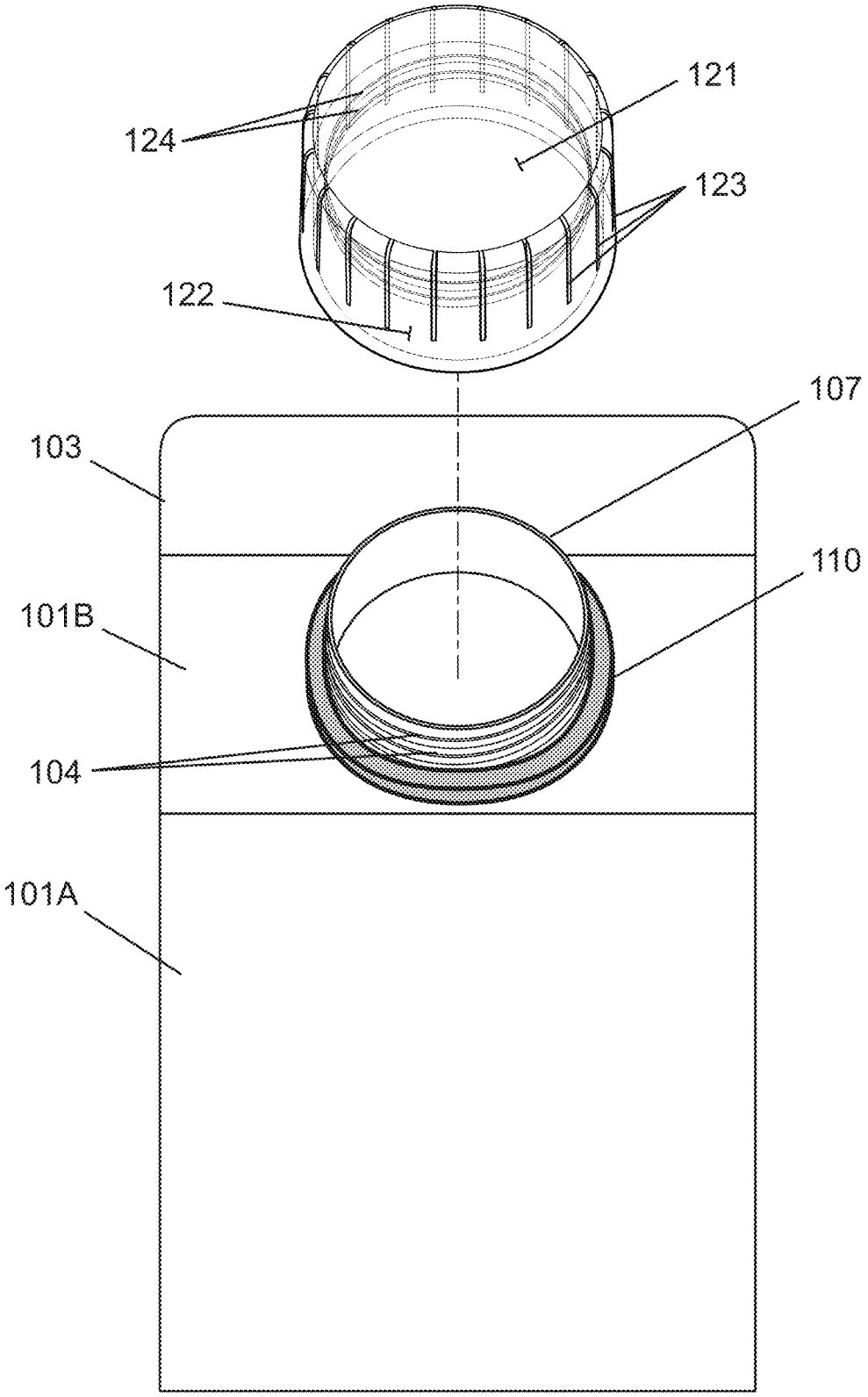

FIGS. 1A-1C show example embodiments of a scented system that can be applied to a box carton having a cap-covered opening for securing a scented article in accordance with the disclosed technology. As shown in FIG. 1A, a box carton 100 includes a carton body 101 able to contain a beverage and including a main body region 101A and an upper body region 101B having an opening 105 from which the beverage may be dispensed (e.g., consumed by the user by drinking from the opening). In the example embodiment shown in FIGS. 1A-1C, the upper body region 101B is structured as a gable top for the box carton 100, which may be referred to as gable top region 101B. In such embodiments, the box carton 100 can include a gable top seal region 103.

Referring to FIG. 1A, the box carton 100 includes a cap 120 that covers the opening 105 of the gable top region 101B. In the example embodiment shown in FIGS. 1A-1C, the opening 105 of the box carton 100 is surrounded by a fitment or spout embodied as a protruding neck 107 to/from which the cap attaches/detaches, i.e. the cap 120 is reversibly attachable to the carton body 101. The cap 120 includes a top wall 121 and a side wall 122 such that the top wall 121 and side wall 122 form shell surrounding an empty interior space of the cap 120. The cap 120 depicted in the example embodiment of FIGS. 1A-1C is cylindrical, but it is understood that it need not be circular and that a plurality of side walls 122 could be formed around the top wall 121 such that the cap 120 has other geometries. Also, the example embodiment of the cap 120 includes optional design features 123 on the outer portion of the cap (identified in FIG. 1C), e.g., which can be for functional purposes like gripping and/or aesthetic purposes like decoration.

In some embodiments, for example, the cap 120 is a screw-top cap that includes threads 124 on the interior of the cap 120 that interface with corresponding threads 104 on the protruding neck 107 of the carton body 101. It is understood that in some embodiments, the cap 120 can reversibly attach to the protruding neck 107 by other attachment mechanism, including but not limited to a snapping mechanism or locking mechanism. In implementations, for example, the cap 120 is able to create a seal with a surface of the upper body region 101B when the cap 120 is completely attached to the carton body 101. In some embodiments, the opening 105 of the carton body 101 can be sealed by a pull-ring (not shown) that detaches from the top of the protruding neck 107 after the cap 120 has been detached from the carton body 101, e.g., usually after the first detachment.

In the present example of the box carton 100 shown in FIGS. 1A-1C, the box carton 100 includes a scented article 110 to enhance the experience of drinking the contained beverage, in which the scented article 110 is attachable to carton body 101 at the protruding neck 107, such that the scented article 110 is enclosable by the cap 120 when the cap 120 is attached to the carton body 101. In the example embodiment, the scented article 110 is a ring disposed around the lower region of the protruding neck 107, e.g., under the corresponding threads of the protruding neck 107 that interfaces with the threads of the cap 120. In the example embodiment, the scented ring is able to release the embedded scent of the scented article 110 into an outer environment of the box carton 100 while the user is consuming the beverage, such that a user's lips would not normally contact the scented article 110 and while the user's nose would be proximate the scented article 110 during consumption of the beverage from the box carton 100.

While FIGS. 1A-1C depict the scented article 110 as a ring and the side walls 122 of the cap 120 surrounding it are curved (e.g., circular), it is understood that it need not be so. So long as the walls are constructed to seal around the entirety of scented article 110 when the side walls 122 contact an interfacing surface of the carton body 101, the scented article 110 can be shaped in other configurations that fit within the interior space between the cap 120 and the protruding neck 107 of the carton body 101 proximate the opening 105.

In some embodiments of a scented box carton system, for example, the scented article 110 can include one or more interior anchors disposed along a single axis or multiple axes of the interior surface of the scented article 110, which may be configured to interface an exterior surface of the protruding neck 107 of the carton body 101. For example, the one or more interior anchors can be one protruding structure that spans a portion or the entire circumference of the interior surface of the scented article 110. Additionally or alternatively, for example, in some embodiments of a scented box carton system, the scented article 110 can include one or more protruding structures disposed on the exterior surface of the scented article 110, referred to as "exterior anchors," which may be configured to interface an interior surface of the side wall(s) 122 of the cap 120. For example, the one or more exterior anchors can be disposed along a single axis or multiple axes of the exterior surface of the scented article 110.

FIG. 1B shows a side view of the example gable top box carton 100 illustrating the scented article 110 enclosed under the cap 120 and within a space between the protruding neck 107 and the interior of the cap 120.

FIG. 1C shows a front view, similar to FIG. 1A, in which the cap 120 is detached from the carton body 101 of the example gable top box carton 100, exposing the scented article 110 to the outer environment.

Figure 2A:
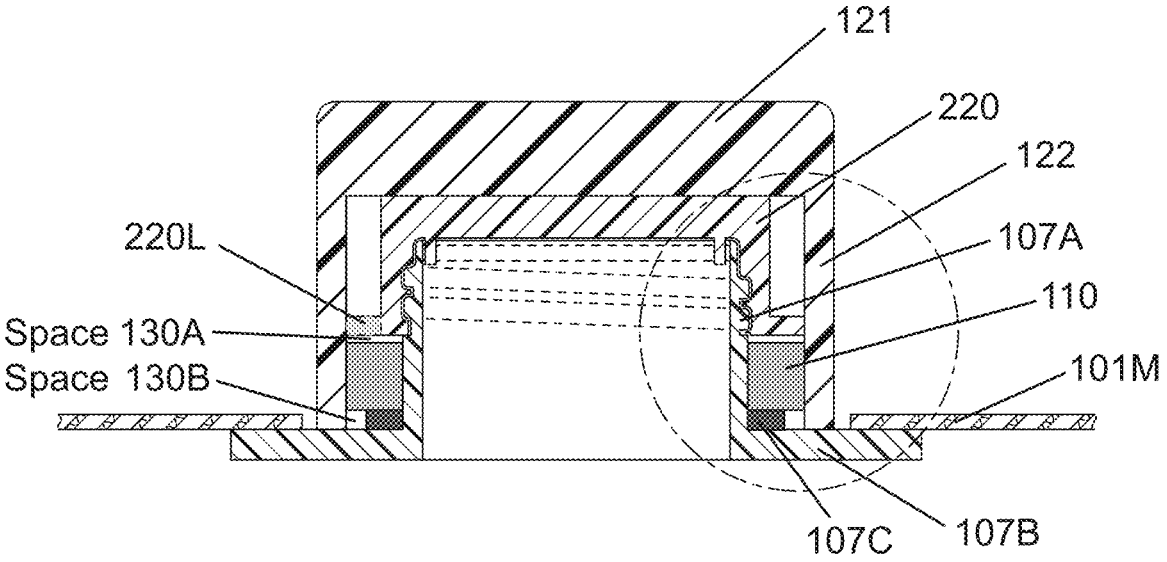
FIG. 2A-2C show a cross-sectional view of a partial cut-away of a cap in the attached position with a carton body encompassing a scented article in an enclosed space for example embodiments of a box carton scented system in accordance with the disclosed technology.
Figure 2B:
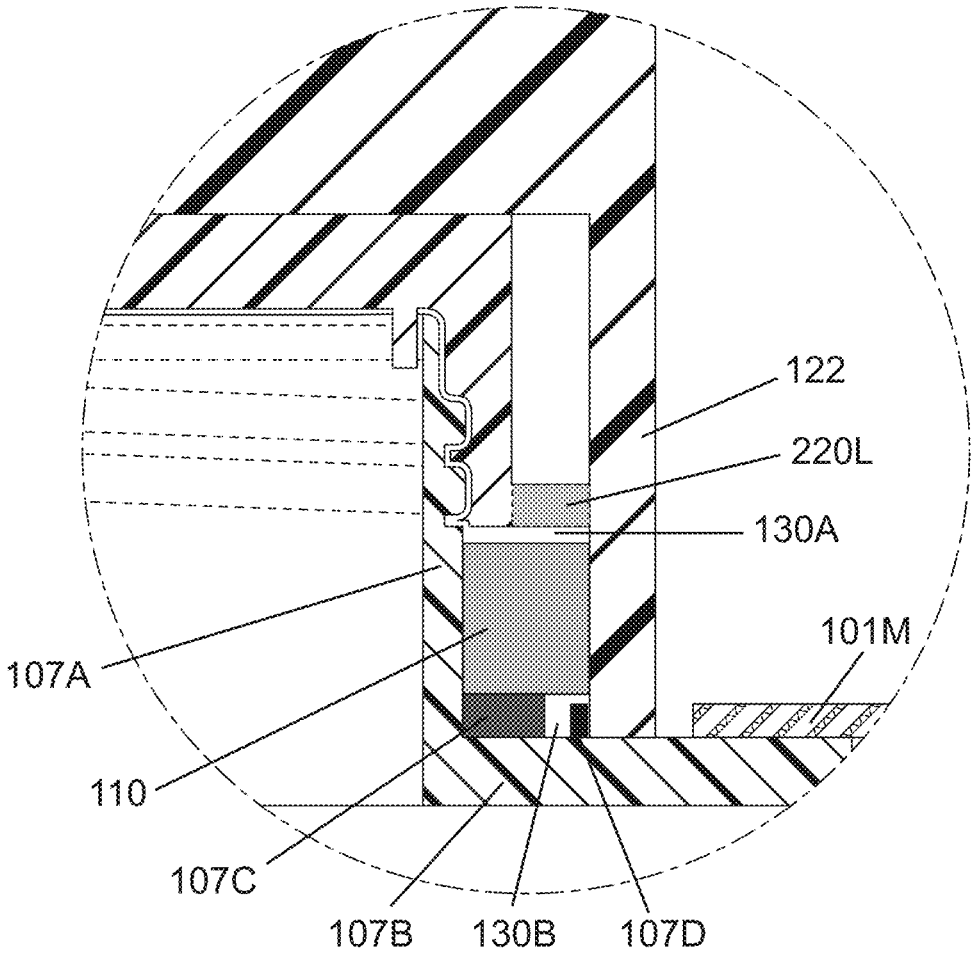
Figure 2C:
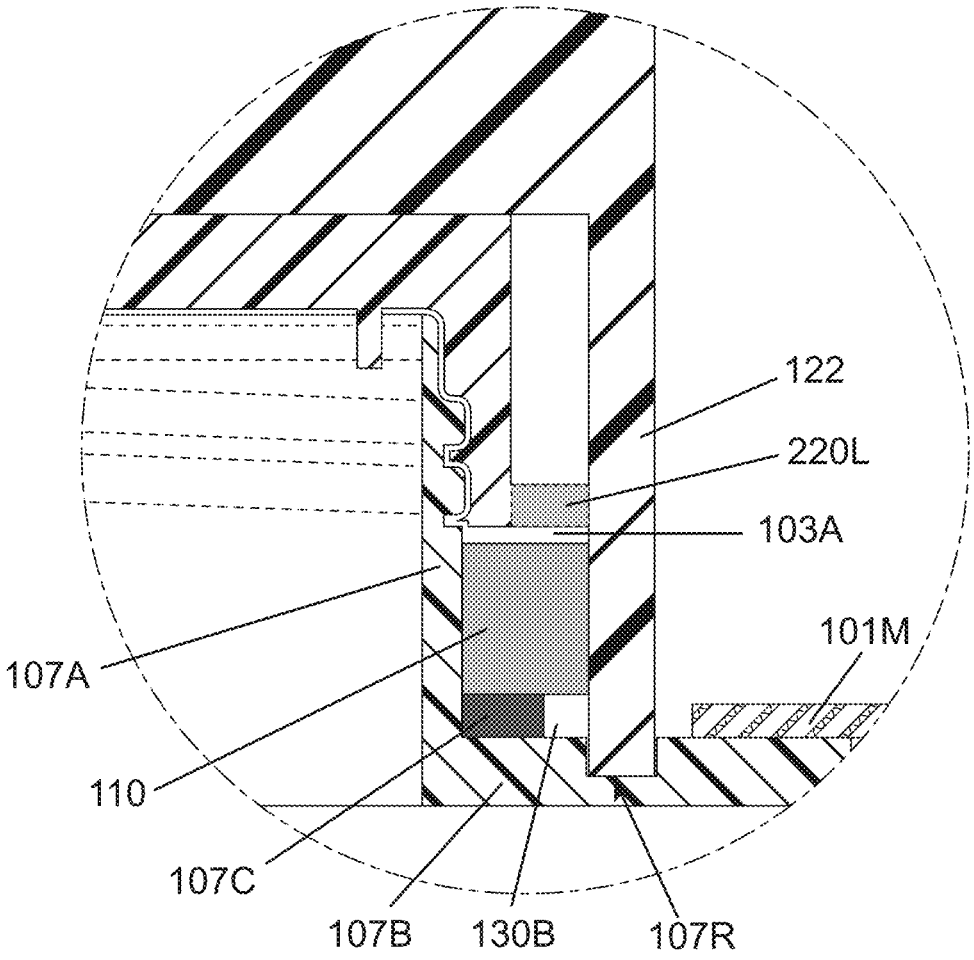

FIG. 2A-2C shows a cross-sectional and partially cut-away view of the cap 120 in the attached position, the scented article 110, and the protruding neck 107 of the carton body 101 for example embodiments of the box carton 100. The cross-sectional, partially cut-away view in FIGS. 2A-2C illustrate the space within which the scented article 110 is enclosed when the cap 120 is attached and its position with respect to the opening 105 for emanating the scent therefrom. The features depicted in the diagrams of FIGS. 2A-2C can be included among the various embodiments of the scented system including the box carton 100 described in FIGS. 1A-1C, or other embodiments of the box carton described in this patent disclosure in accordance with the present technology.

As shown in FIG. 2A, the protruding neck 107 of the carton body 101 includes a base region 107B and a projection region 107A. The base region 107B of the protruding neck 107 is disposed within the layers of the upper body region 101B, such that at least an outer layer 101M covers the upper surface of the base region 107B. The projection region 107A extends outward from the base region 107B and forms the opening 105 of the box carton 100. For example, the projection region 107A can include the corresponding threads 104 toward an outward portion of the projection region 107A. The scented article 110 is positioned at an inward portion of the projection region 107A, e.g., such that it is located at a suitable position away from the opening 105 to allow the user's lips to contact the protruding neck 107 for drinking the beverage without having to contact the scented article 110.

As illustrated in the diagram of FIG. 2A, the protruding neck 107 can include a ledge portion 107C that is disposed above the base region 107B near its interface with the projecting region 107A. In this example embodiment, the ledge portion 107C includes an annular radius that is less than that of the scented article 110 so that the box carton 100 includes a space 130B below the scented article 110 that is enclosed when the cap 120 is attached to the carton body 101.

In some embodiments, like the example shown in FIG. 2A, the cap 120 can include an inner cap component 220 which is attachable to the outer cap body of the cap 120. For example, the inner cap component 220 and the outer cap body can be separable pieces in some embodiments of the cap 120; whereas in other embodiments of the cap 120, the inner cap component 220 and the outer cap body can be integrated as a single piece, for example. In the example shown in FIG. 2A, the inner cap component 220 includes the threads 124 that facilitate attachment of the cap 120 to the carton body 101 via the threads 124 interfacing with the corresponding threads 104 of the protruding neck 107.

The inner cap component 220 can include a side portion (not shown) that contacts an interior surface of the side wall 122, which can secure the inner cap component 220 within the interior of the cap 120. The structure of the side portion can define a space 130A above the scented article 110 that is enclosed when the cap 120 is attached to the carton body 101. Notably, for example, when the side wall 122 of the cap 120 is configured to have an inner radius to match or barely exceed the outer radius of the scented article 110 (as a ring encircling the projection region 107A), as shown in the diagram of FIG. 2A, such that the above space 130A and below space 130B can be distinct spaces to trap the scent that emanates from the scented article 110 when the cap 120 is attached. Yet, in some embodiments, the side wall 122 of the cap 120 can be configured to have an inner radius greater than the outer radius of the scented article 110 (as a ring), and the spaces 130A and 130B are effectively one space.

The space enclosed within the cap 120 allows the scent from the scented article 110 to build up during the time the cap 120 is attached to the carton body 101. In this manner, the built-up scent can create a scent burst effect for the user to inhale while drinking from the box carton 100 shortly after detaching the cap 120.

In some embodiments, for example, the inner cap component 220 includes an optional bridge portion 220L that extends outward from the inner cap component 220 near the projection region 107A at a location above the scented article 110, and which can contact the side wall 122 to define the above space 130A. In the example embodiment shown in FIG. 2A, the bridge portion 220L is closely spaced above the scented article 110; yet in some embodiments, the bridge portion 220L can be spaced further from the scented article 110 defining a larger above space 130A. Further, in some embodiments, the optional bridge portion 220L can include openings to an empty space above it to integrate the above space 130A with the empty space above the optional bridge portion 220L.

FIG. 2B shows an example embodiment of the of the box carton 100 for sealing the cap 120 in the attached position to the protruding neck 107 of the carton body to enclose the scented article 110 and preserve the scent. In this embodiment, the protruding neck 107 includes an adjacent base wall 107D projecting upward from the base region 107B at a location where the outer surface of the adjacent base wall 107D will make contact with the inner surface of the side wall 122 of the cap 120 when the cap 120 is completely attached to the box carton 100 (e.g., screwed on the protruding neck 107). The interface between the adjacent base wall 107D and the side wall 122 creates a contact seal, such that, when the cap 120 is in the attached or closed position, the contact seal created by the cap 120 and protruding neck 107 encloses the scented article 110 within the space between and locks in the scent. Yet, in some embodiments, for example, the adjacent base wall 107D projects upward from the base region 107B at a location where the inner surface of the adjacent base wall 107D (i.e., inner surface toward the protruding neck 107) will make contact with the outer surface of the side wall 122 of the cap 120 when the cap 120 is completely attached to the box carton 100 (e.g., screwed on the protruding neck 107).

FIG. 2C shows another example embodiment of the of the box carton 100 for sealing the cap 120 in the attached position to the protruding neck 107 of the carton body to enclose the scented article 110 and preserve the scent. In this embodiment, the protruding neck 107 includes a cavity or ridge 107R indenting inward into the base region 107B at a location where the side wall 122 of the cap 120 will make contact with the protruding neck 107 when the cap is completely attached to the box carton 100 (e.g., screwed on the protruding neck 107). The cavity or ridge 107R can include a width that is substantially the same as the width of the side wall 122 (e.g., at the bottom portion of the side wall 122) such that at least one of the inner surface, the bottom surface or the outer surface of the side wall 122 makes contact with one of the walls of the cavity or ridge 107R. In this manner, the interface between the cavity or ridge 107R and the side wall 122 creates a contact seal, such that, when the cap 120 is in the attached or closed position, the contact seal created by the cap 120 and protruding neck 107 encloses the scented article 110 within the space between and locks in the scent.

The contact seal serves multiple purposes. In certain embodiments, the contact seal is air and water tight to preserve the scented article inside. In this way, when the box carton is first constructed, shipped, and deployed, e.g., in a retail environment, there will be no loss of scent, nor will the scents of adjacent box cartons mix in the air in a store aisle. The contact seal can also function on reuse to preserve the scented article and extend its use.

There are various ways to accomplish this type of contact seal. In the initial construction, it may be desirable to have the walls be connected, either by an adhesive or a thin layer of material that can break away upon the carton's first opening. Additionally or alternatively, and for reversible sealing of the scented article during multiple uses, the seal can be accomplished by ensuring the materials used to construct the walls have the proper balance of give (elasticity) and rigidity to accomplish the seal when mechanically compressed against each other, by incorporation of an additional lip of material on each of the walls at the connection point to provide additional surface area to enhance the seal, and/or incorporation of an O-ring or other flexible structure between the walls to enhance the seal. There are many example embodiments of component assemblies, described throughout this patent disclosure, that produce the seal of the scented article in a space that traps the scent within, while allowing the seal to be controllably unsealed to expose at least a portion of the scented article to release and/or emanate the scent. While the component assemblies to produce a reversible seal may be described in the context of a single embodiment, the component assemblies can also be implemented in multiple embodiments separately or in any suitable subcombinations.

It is understood that the various embodiments of the scented system including the box carton 100, such as those depicted in FIGS. 2A-2C, need not use a ring-shaped scented article; rather, any shape, including a portion of a curved structure that fits in the space formed between the walls of the cap 120 and the carton body 101 (e.g., walls of the protruding neck 107), can be used so long as the walls are constructed to seal around the entirety of scented article 110 when the cap 120 is closed.

For example, box carton type beverage containers are typically sold pre-filled at retail and intended for single use. In some of the embodiments described herein, the scented article 110 may be attached to the box carton 100 during its initial assembly and filling with a beverage in a way that it is nonremovable by the end user. Yet, in some embodiments, the scented article 110 may be attached in a removable fashion so that it can be replaced when the end user desires to do so. While nonremovable attachment can be accomplished with chemical adhesives, FIG. 2D also shows several manners by which the scented article 110 can be removably attachable (e.g., capable of being attached and detached) without the use of additional chemicals that might interfere with the scented article 110.

Figure 2D:
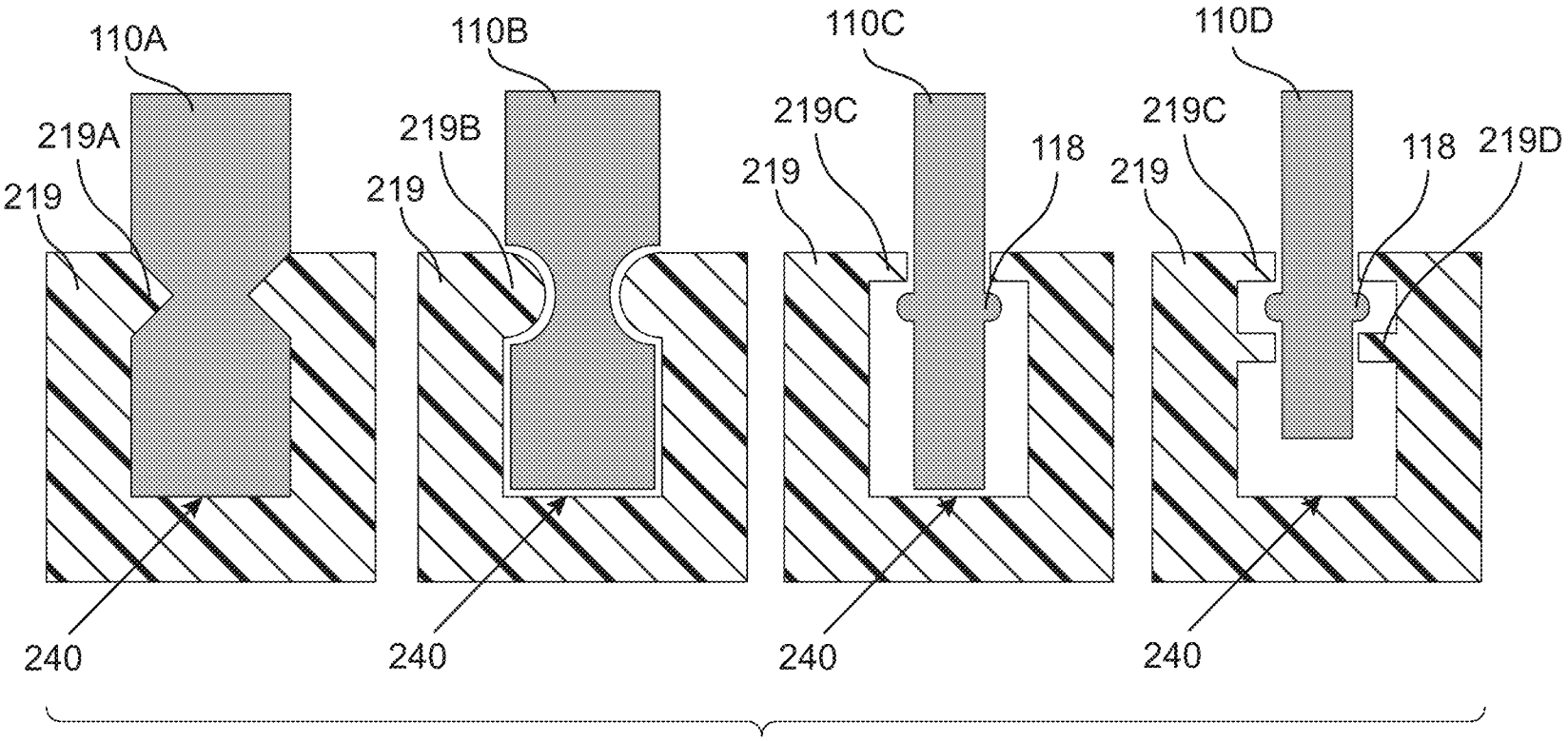
FIG. 2D shows diagrams of example embodiments for securing the scented article to the carton body and/or the cap of an example box carton container.

FIG. 2D shows diagrams of four example embodiments for securing the scented article 110 to the carton body 101 (e.g., protruding neck 107) and/or the cap 120. In the various configurations, for example, the scented article 110 can be secured in a channel 240 formed by the carton body 101 (e.g., protruding neck 107), formed by the cap 120, or formed by the carton body 101 (e.g., protruding neck 107) and formed by the cap 120.

In left-most diagram of FIG. 2D, the scented article 110 includes a structural portion 110A that is virtually the same width as width of the channel 240 of the receiving structure (e.g., a structure of the carton body 101 or a structure of the cap 120). In this example, the scented article portion 110A includes indentions configured to receive triangular projections 219A that project from the channel walls 219. The triangular projections 119A from the channel walls 219 match the shape of these cavities or indentions and physically contact the sides of scented article portion 110A once it is pressed downward into place during assembly. This example configuration forms a rigid attachment between the structural portion 110A of the scented article 110 and the receiving structure of the carton body 101 or cap 120 that should secure scented article 110. In some examples, there can be a plurality of triangular projections 219A disposed along the channel walls 219 of the channel 240 and configured to align within corresponding plurality of cavities or indentions of the scented article portion 110A. While this example diagram shows the triangular projections 219A protruding from the channel walls 219 to align within the cavities or indentions of the scented article portion 110A, it is understood that the triangular projections 219A may be contained on the walls of the scented article portion 110A and the cavities or indentions may be disposed on the channel walls 219 of the channel 240.

The center-left diagram of FIG. 2D shows a slight variation of that example arrangement, in which projections extending from the channel walls 219 of the channel 240 are rounded instead of triangular, shown as rounded projections 219B, such that the projections 219B generally match the cavities or indentions on the sides of a structural portion 110B of the scented article 110. With such rounded projections, the scented article portion 110B (as well as scented article portion 110A in the example above) can be structured to have a width slightly narrower than the channel between the walls surrounding it. For example, physical contact between the projections 219B and indentions of the scented article portion 110B need not be maintained so long as projections 219B extend sufficiently into the sides of scented article portion 110B to keep the scented article 110 from dislodging.

In center-right diagram of FIG. 2D, the scented article 110 includes a structural portion 110C having walls constructed with projections 118 that projects out into the channel 240 in which scented article portion 110C is mounted. Channel walls 219 include a lip 219C, e.g., toward the top of the channel 240, which restrain the scented article portion 110C within the channel 240 due to the projections 118 extending from the exterior surface of the scented article portion 110C out toward the walls. The projections 118 of the scented article portion 110C have a width dimension from end-to-end that is larger than the width of the opening into the channel 240 due to the extension of the lip 219C. For example, the projections 118 of the scented article portion 110C can be rounded like projections 219B or triangular like projections 219A, or have other shapes based on other material properties of the scented article that allow it to be pushed into the channel such that the projections 118 pass the lip 219C of the channel walls 219.

The right-most diagram of FIG. 2D is a variation of that example arrangement where, in addition to the lip 219C extending from the channel wall 219, an additional lower lip 219D is used to bookend projection 118 of the scented article portion 110D. Similarly, in some embodiments, a third lip (not shown) can be disposed below the lower lip 219D, such that a scented article having two projections, e.g., projection 118 and a lower projection projecting from scented article portion 110D (not shown), may align in the spacing between the respective lips of the channel wall 219. This configuration can, among other things, allow the scented article to be manufactured with less material so that it need not abut the bottom of the channel but yet still be secured within the channel to allow for controllable reversible attachment.

FIGS. 3A-3B and 4A-4C present other arrangements for how a scented system can be applied to a box carton type beverage container of different shapes and styles, e.g., such as non-gable top box cartons. Similar to the gable-top box carton 100 in FIGS. 1A-1C, the non-gable top box cartons 300 and 400 in FIGS. 3A-3B and FIGS. 4A-4C, respectively, include the carton body 101 for containing a beverage, which comprises the main body region 101A and the upper body region 101B having the opening 105 from which the beverage may be dispensed (e.g., consumed by the user by drinking from the opening). The opening 105 of the box carton 300 and the box carton 400 is surrounded by the protruding neck 107 to/from which the cap 120 attaches/detaches, i.e., the cap 120 is reversibly attachable to the carton body 101. The box carton 300 and the box carton 400 include the scented article 110, which is attachable to carton body 101 at the protruding neck 107, such that the scented article 110 is enclosable by the cap 120 when the cap 120 is attached to the carton body 101. Yet, in these example non-gable top box carton embodiments shown in FIGS. 3A-3B and 4A-4C, the protruding neck 107 extends from the top of the carton body 101 such that the cap 120 reversibly attaches to the top of the box carton 300 and box carton 400, respectively. The box carton 300 and/or the box carton 400 are able to preserve the scent emanating from the scented article 110 based on, in some embodiments, the interface between the adjacent base wall 107D and the side wall 122, which creates a contact seal, such that, when the cap 120 is in the attached or closed position, the contact seal created by the cap 120 and protruding neck 107 encloses the scented article 110 within the space between and locks in the scent, as shown in FIG. 2B; whereas in some embodiments, the box carton 300 and/or the box carton 400 are able to preserve the scent emanating from the scented article 110 based on the interface between the cavity or ridge 107R and the side wall 122 creates a contact seal, such that, when the cap 120 is in the attached or closed position, the contact seal created by the cap 120 and protruding neck 107 encloses the scented article 110 within the space between and locks in the scent, as shown in FIG. 2C.

Figure 3A:
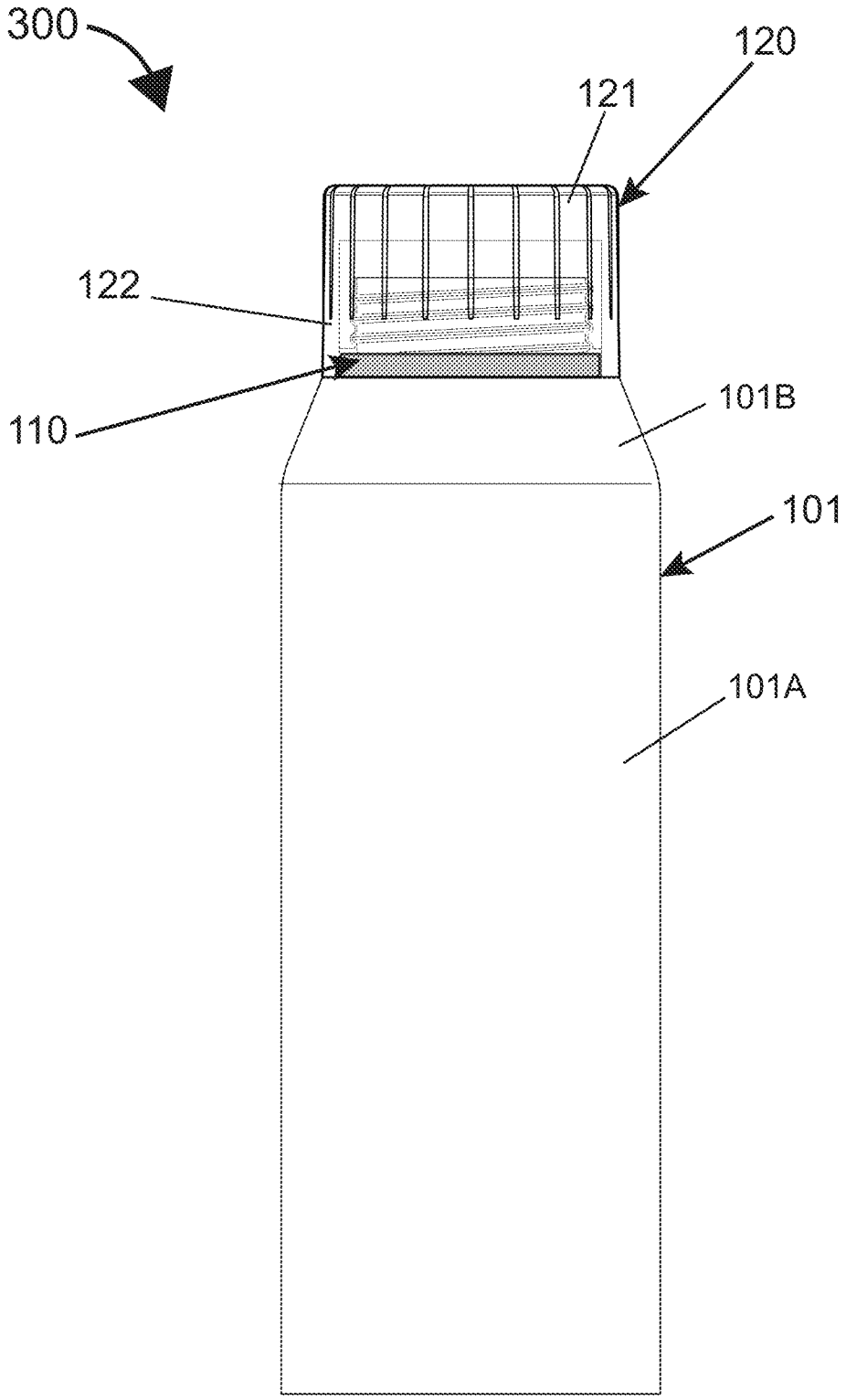
FIGS. 3A and 3B show diagrams of example embodiments of a scented system that can be applied to a non-gable box carton having a cap-covered opening for securing a scented article in accordance with the disclosed technology.

FIG. 3A shows a side view of the example non-gable top box carton 300 illustrating the scented article 110 enclosed under the cap 120 and within a space between the protruding neck 107 and the interior of the cap 120.

Figure 3B:
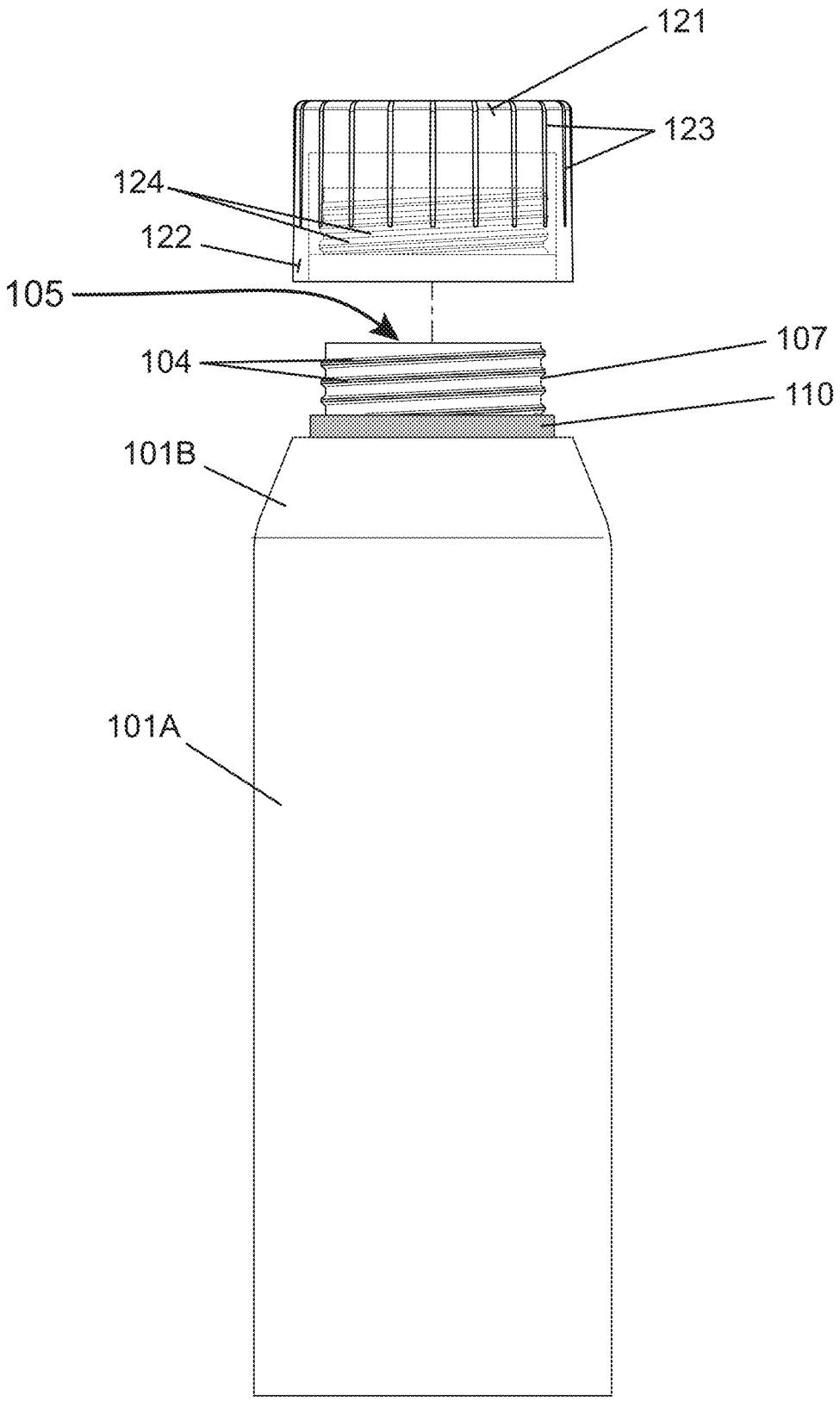

FIG. 3B shows the side view, similar to FIG. 3A, in which the cap 120 is detached from the carton body 101 of the example non-gable top box carton 300, exposing the scented article 110 to the outer environment.

Figure 4A:
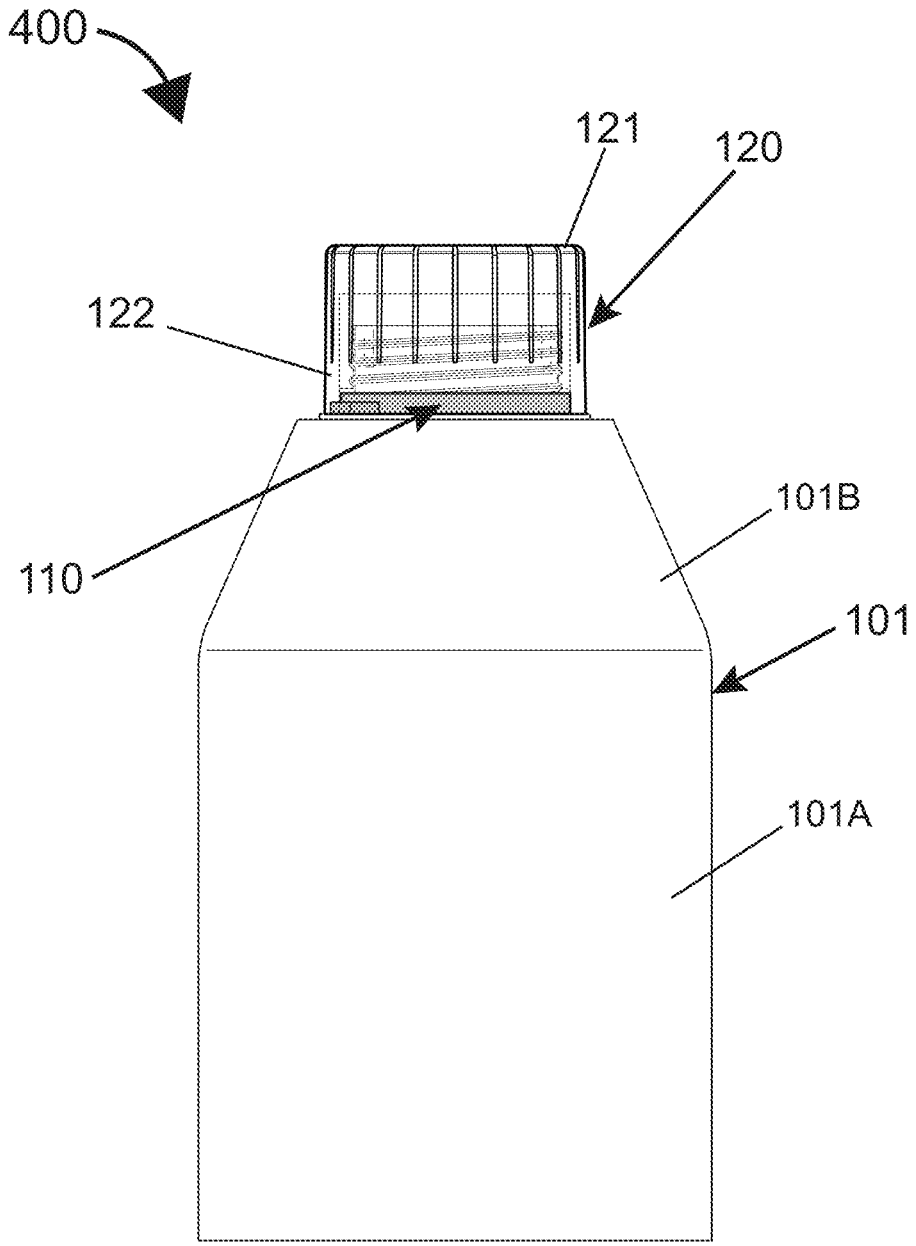
FIGS. 4A-4C show diagrams of example embodiments of a scented system that can be applied to another type of non-gable box carton having a cap-covered opening for securing a scented article in accordance with the disclosed technology.

FIG. 4A shows a side view of the example non-gable top box carton 400 illustrating the scented article 110 enclosed under the cap 120 and within a space between the protruding neck 107 and the interior of the cap 120.

Figure 4B:
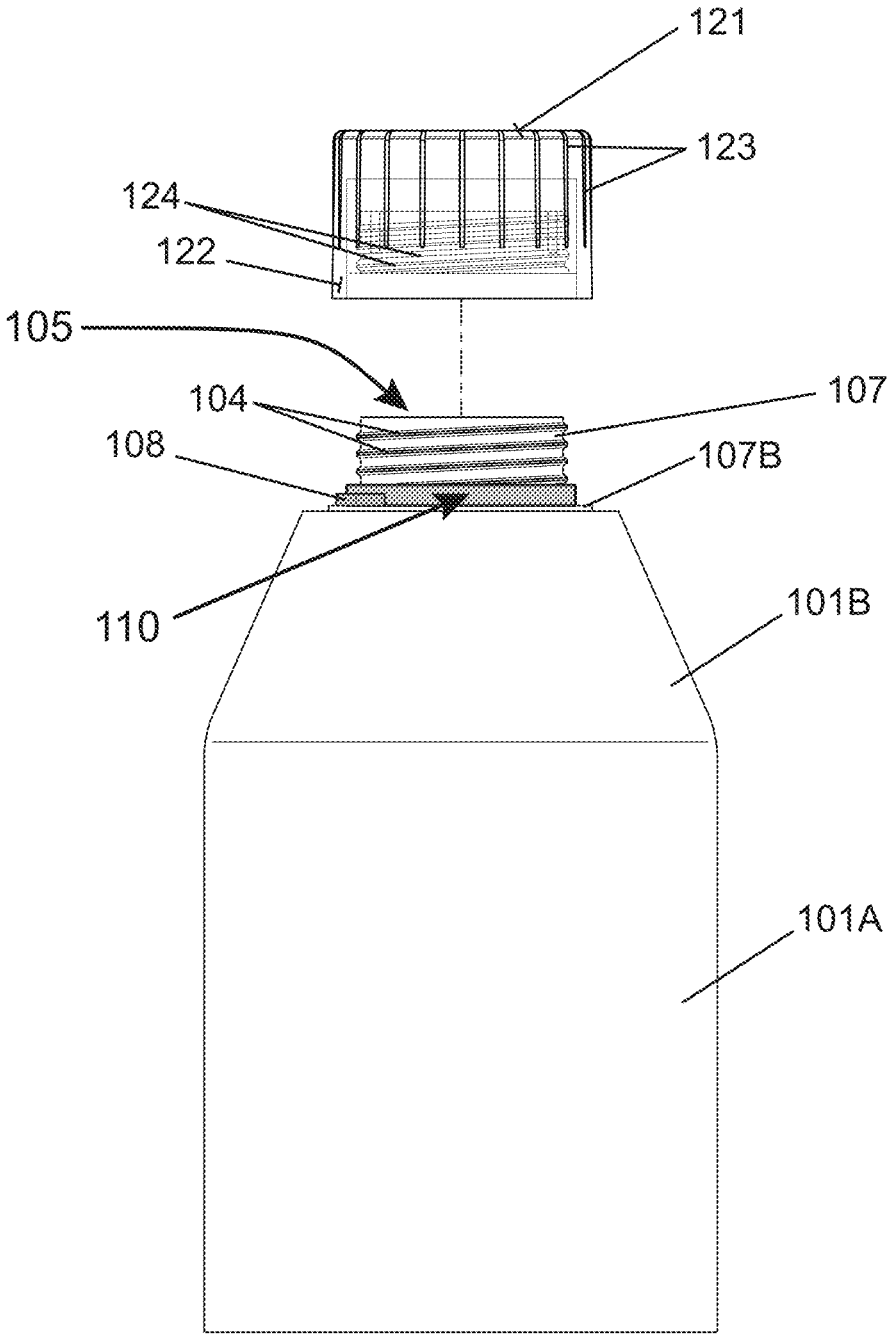

FIG. 4B shows the side view, similar to FIG. 4A, in which the cap 120 is detached from the carton body 101 of the example non-gable top box carton 400, exposing the scented article 110 to the outer environment.

Figure 4C:
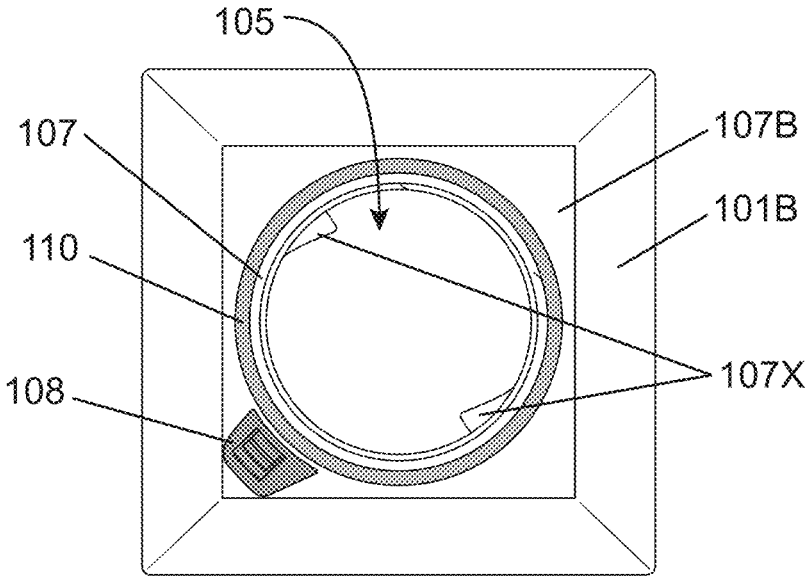

FIG. 4C shows a top view of the carton body 101 of the example non-gable top box carton 400, showing the differing structure of the box carton 400 from that of box carton 300. The box carton 400 includes a locking mechanism 108 positioned on the top surface of the upper body region 101B (e.g., which, in some embodiments) can be on the base region 107B of the protruding neck 107). The locking mechanism 108 can interface with a protrusion from an outer, lower region of the side wall 122 of the cap 120 (not shown) when the cap 120 is completely secured to the protruding neck 107. In some embodiments, the locking mechanism 108 includes a cavity to which the protrusion from the cap 120 receives. In other embodiments, the side wall 122 of the cap 120 includes the cavity and the locking mechanism 108 includes the protrusion. In some embodiments, the locking mechanism 108 serves as a stop against the cap 120 from turning further.

In some embodiments, for example, the box carton 400 includes one or more interior abutments 107X on the interior of the protruding neck 107, which can serve as a stop against the cap 120 from turning further. In such embodiments, the cap 120 can include an interior annulus portion extending into the opening (e.g., the interior of the protruding neck 107) that can contact the interior abutment(s) 107X when the cap has been completely attached.

The example embodiments described above include features that address and balance a number of design tradeoffs and challenges presented when engineering and constructing containers for beverage consumption to augment a user's drinking experience by delivering a scent from a box carton container using a scented article. For example, the scented article should be able to deliver scent reliably to the consumer of the beverage repeatedly across multiple uses, even as the box carton container is exposed to various environmental stressors such as heat, cold, and/or washing. The scented article may be presented in close proximity to the consumer's nose while the consumer is drinking the beverage, but it is optimal that neither the beverage nor the consumer's lips should physically touch the scented article. The scented article should be maintained a consistent distance from the user's nose no matter how the container is used so that the intensity of the scented article can be calibrated to be strong enough to stimulate a sense of taste but not so strong that it will antagonize the user and those in a proximate environment of the user. The scented article should be sealable to preserve the scent during product manufacturing, shipping and storage to prevent cross-contamination of scents from the same or differing scented articles in proximity to the product. The scented article should be large enough to hold a sufficient amount of scent such that it can stimulate a sense of taste, while small enough to minimize construction materials and integrate and attach to the beverage container in the precise location to optimally deliver and preserve the scent. The location of the scented article should expose enough surface area that scent is released with sufficient intensity to stimulate a sense of taste. Moreover, different types of box carton containers serve varying functions, and those functions must still be satisfied despite the additional delivery of the scent from the scented article to the consumer. The above example embodiments of the scented articles and box carton-type beverage containers are engineered to overcome at least some if not all of these challenges to provide the associated benefits to the user to create an enjoyable drinking experience through controlled delivery of a scent for augmenting the user's taste perception.

Scented Materials for Scented Articles in Beverage Containers

As discussed above, the ability to control scent delivery and preserve the scent for repeated scent deliveries by the particular box carton container may also be impacted by the materials engineered to form the scented article. For the example scented articles to be attachable to and/or incorporated in a drinking container, the scented article typically requires a small size relative to the container structures (e.g., carton body and/or cap of the box carton container), and therefore limited surface area, while also possessing a durable, solid structure to prevent unintentional detachments from the container (e.g., which could cause choking), unwanted leaching of chemicals into a beverage, or unintended uses (e.g., user eating the scented article)—and, all the while, must still provide a strong-enough scent for the user to smell while consuming the beverage, but not too-strong of a pungent scent to adversely affect the user's beverage experience. For the scented article to achieve such functionality with a small size and sufficient structure, the fragrance composition that creates the scent in the scented article should be loaded at and must maintain a sufficient concentration range in the base material to produce a robust, stable scented product suitable for applications like scented beverage container systems.

Example embodiments of scented materials to produce the scented articles can include a fragrance material (e.g., such as a fragrant or scented compound in the form of an oil, emulsion or other liquid or liquid like phase) incorporated into a base material (e.g., a plastic). In some examples, the fragrant compounds are engineered to be compatible with certain polymer base materials, such as polyolefin, in which the fragrant compounds are integrated into the base material at particularly high loads, such as in % wt ranges of 10% or greater, e.g., 10-30% fragrant compound. The fragrant material can include an odorless flavor carrier compound and a scent flavor compound, which can be formed as a scented oil. In some embodiments, the odorless flavor carrier compound includes medium chain triglyceride (MCT) and Triacetin (1,2,3-triacetoxypropane). In such embodiments, for example, the flavor or fragrance material, such as fragrance oil, includes MCT, Triacetin, and the scent-flavor compound, in which the MCT includes a % wt in a range of 50-80% wt, the Triacetin includes a % wt in a range of 15-25% wt, and the scent-flavor compound includes a % wt in a range of 1-30% wt. In some examples, the fragrance oil includes MCT at a 50-70% wt range (e.g., 60% wt), triacetin at a 15-25% wt range (e.g., 20% wt), and the scent-flavor compound at 15-25% wt range (e.g., 20% wt).

In various embodiments of scented articles in accordance with the present technology, for example, the scented article can include the scented material (e.g., fragrance material incorporated into a base material) that has an exterior surface that includes cavities (e.g., pores, troughs, etc.) that recede inward with respect to the exterior surface of the scented article and/or protrusions (e.g., bumps, ridges, etc.) that protrude outward with respect to the surface of the exterior surface. In various embodiments, for example, the scented article can include a uniform exterior surface of the scented material. In various embodiments, for example, the cavities, protrusions, and/or uniform surface can be organized along the surface of the scented article in a variety of arrangements, e.g., including an array of periodic or aperiodic positioning, or randomly. For example, the scented article can include certain regions of the exterior surface to have cavities, the protrusions and/or the uniform surface; and/or the exterior surface can have a mixture of the cavities, the protrusions, and/or the uniform surface. In implementations, for example, the cavities and/or protrusions provide additional surface area to the scented article that can increase the concentration of the scent exposed to the outer environment (e.g., air), and thereby enhance the delivery of the scent to the user. In some embodiments, for example, the cavities and/or protrusions can be used to create letters, shapes, or symbols as a form of advertising or product differentiation.

In some embodiments, the scented articles can contain the scent by various methods and materials, including incorporating the scent into the material of the article, e.g., during a fabrication process to produce the article, as described in U.S. Pat. No. 9,801,969B2 and U.S. Patent Publication No. 2019/0367230A1, which are both incorporated by reference herein as part of the this patent document for all purposes. For example, the scented article (e.g., scented ring) can be fabricated using a plastic material, e.g., polyethylene, polyurethane or other example materials described herein, that is loaded with the odorous compound or aggregate that produces the scent to a desired concentration, e.g., which can be selected based on multiple variables including the type of scent (e.g., degree of pungency of a particular scent).

EXAMPLES

In some embodiments in accordance with the present technology (example A1), a scent delivery system includes a cap removably attachable to a drinking container at an opening of the drinking container, the cap being moveable between an open position that allows a fluid beverage within the drinking container to flow outward and a closed position that prevents the beverage to flow outward; and a scented article that couples to the cap and operable to generate a scent capable of stimulating an olfactory sensation of a user including during consumption of the beverage when the cap is in the open position, wherein, when in the cap is in closed position, a seal is created by the cap and a base region of the drinking container to enclose the scented article and lock in the scent.

In some embodiments in accordance with the present technology (example A2), a scent delivery system for a beverage contained in a box carton container includes a box carton container to contain a fluid beverage, the box carton container including a main body region and an upper body region, the upper body region including a fitment protrusion having an opening into the inside of the box carton container; a cap attachable to the fitment protrusion of the box carton container to cover the opening, the cap operable to move, reversibly, between a closed position that prevents the beverage contained within the box carton container to flow outward from the box carton container and an open position that allows the beverage within the box carton container to flow outward while the cap is attached to the box carton container; and a scented article that couples to the cap and operable to generate a scent capable of stimulating an olfactory sensation of a user including during consumption of the beverage when the cap is in the open position, wherein, when the cap is attached to the fitment protrusion in the closed position, an interior surface of the cap and an external surface of the box carton container create a contact seal that encloses the scented article in a space within and locks in the scent.

Example A3 includes the scent delivery system of any of examples A2-A5, wherein the fitment protrusion includes a base surface to which a bottom surface of a side wall of the cap contacts when the cap is attached to the fitment protrusion in the closed position.

Example A4 includes the scent delivery system of any of examples A2-A5, wherein the fitment protrusion includes an adjacent base wall projecting upward from a base surface of the fitment protrusion, the adjacent base wall is positioned on the base surface such that an outer side surface of the adjacent base wall is able to contact an inner side surface of a side wall of the cap when the cap is attached to the fitment protrusion in the closed position, wherein an interface between the adjacent base wall and the side wall creates the contact seal.

Example A5 includes the scent delivery system of any of examples A2-A5, wherein the fitment protrusion includes a ridge indenting inward into a base surface of the fitment protrusion, the ridge is positioned on the base surface such that a surface of the ridge is able to contact an outer surface of a side wall of the cap when the cap is attached to the fitment protrusion in the closed position, wherein an interface between the adjacent base wall and the side wall creates the contact seal.

In some embodiments in accordance with the present technology (example B1), a scent delivery system for a beverage contained in a box carton includes a box carton container to contain a fluid beverage, the box carton container including a main body region and an upper body region, the upper body region including a spout having an opening into the inside of the box carton container; a cap attachable to the spout of the box carton container to cover the opening, the cap operable to move, reversibly, between (i) a closed position that prevents the beverage contained within the box carton container to flow outward from the box carton container while the cap is attached to the box carton container and (ii) an open position that allows the beverage within the box carton container to flow outward while the cap is unattached to the box carton container; and a scented article coupled to the box carton container and operable to generate a scent capable of stimulating an olfactory sensation of a user including during consumption of the beverage when the cap is in the open position, wherein, when the cap is attached to the spout in the closed position, an interior surface of the cap and an external surface of the box carton container create a contact seal that encloses the scented article in a space within and locks in the scent.

Example B2 includes the scent delivery system of any of examples B1-B22, wherein the interior surface of the cap is a bottom surface of a side wall of the cap, and wherein the spout includes a base surface to which the bottom surface of the side wall of the cap contacts when the cap is attached to the spout in the closed position to create the contact seal.

Example B3 includes the scent delivery system of any of examples B1-B22, wherein the interior surface of the cap is an inner side surface of a side wall of the cap, wherein the spout includes a base surface and an adjacent base wall projecting upward from the base surface, and wherein the adjacent base wall is positioned on the base surface such that an outward side surface of the adjacent base wall contacts the inner side surface of the side wall of the cap when the cap is attached to the spout in the closed position to create the contact seal.

Example B4 includes the scent delivery system of any of examples B1-B22, wherein the interior surface of the cap is a bottom surface of a side wall of the cap, and wherein the spout includes a ridge indenting inward into a base surface of the spout, where the ridge is positioned on the base surface such that a surface of the ridge contacts the bottom surface of the side wall of the cap when the cap is attached to the spout in the closed position to create the contact seal.

Example B5 includes the scent delivery system of any of examples B1-B22, wherein the spout includes a base surface and ledge structure disposed on the base surface and configured to support the scented article above the base surface, wherein the ledge structure includes an annular radius that is less than an outward dimension of the scented article so as to create a space below the scented article that is enclosed when the cap is attached to the spout in the closed position.

Example B6 includes the scent delivery system of example B5, wherein the interior surface of the cap includes a first interior surface that makes contact with the external surface of the box carton container when the cap is attached to the spout in the closed position and a second interior surface that makes contact with a side wall of the spout when the cap is attached to the spout in the closed position, wherein the cap includes a bridge structure that spans between the first interior surface and the second interior surface, such that the bridge structure is positioned within the cap to create a second space above the scented article that is enclosed when the cap is attached to the spout in the closed position.

Example B7 includes the scent delivery system of example B6, wherein space above the scented article and the space below the scented article enable the system to trap the scent emanated from the scented article so as to concentrate the scent when the cap is attached to the spout in the closed position.

Example B8 includes the scent delivery system of example B7, wherein the system is operable to release a concentrated scent when the cap is detached from the spout in the open position to facilitate a burst of the concentrated scent to the external environment around the spout.

Example B9 includes the scent delivery system of any of examples B1-B22, wherein the scented article includes one or more projections along at least one side surface of the scented article, and wherein the box carton container includes one or more cavities on an exterior side surface of the upper body region, such that the one or more projections of the scented article align with and fit within the one or more cavities of the box carton container to couple the scented article to the box carton container.

Example B10 includes the scent delivery system of example B9, wherein the scented article is reversibly attachable to the box carton container via coupling of the one or more projections and the one or more cavities.

Example B11 includes the scent delivery system of example B9, wherein the scented article is irreversibly attached to the box carton container via coupling of the one or more projections and the one or more cavities.

Example B12 includes the scent delivery system of any of examples B1-B22, wherein the scented article is a scented ring that surrounds an outer wall of the spout.

Example B13 includes the scent delivery system of example B12, wherein the scented ring includes one or more interior anchor structures that project from an interior wall of the scented ring, wherein the scent ring is configured to fasten around the spout of the box carton container based on contact between the one or more interior anchor structures of the scented ring and at least one protrusion structure of the box carton container that projects outward from the spout.

Example B14 includes the scent delivery system of example B13, wherein the one or more interior anchor structures are positioned below the at least one protrusion structure.

Example B15 includes the scent delivery system of example B12, wherein the scented ring includes one or more indention structures that project inward from an interior wall of the scented ring, wherein the scent ring is configured to fasten around the spout of the box carton container based on contact between the one or more indention structures of the scented ring and at least one protrusion structure of the box carton container that projects outward from the spout, wherein a protrusion structure is able to fit within an indention structure.

Example B16 includes the scent delivery system of any of examples B1-B22, wherein the scent includes a volatile chemical agent loaded within at least a portion of the scented article.

Example B17 includes the scent delivery system of any of examples B1-B22, wherein the upper body region of the box carton container includes a triangular shape portion having a first side and a second side that span from two sides of the main body region and converge at an apex that forms a gable top of the box carton container, wherein the spout is positioned on the first side of the triangular shape portion of the upper body region.

Example B18 includes the scent delivery system of any of examples B1-B22, wherein the upper body region of the box carton container includes one or more side walls coupled to a top wall, wherein the spout is positioned on the top wall.

Example B19 includes the scent delivery system of any of examples B1-B22, wherein the box carton container is a paper-based box carton.

Example B20 includes the scent delivery system of any of examples B1-B22, wherein the spout includes a base surface and a curved projection wall that extends outward from the base surface to form the opening of the box carton container, and wherein the base surface is coupled to an outer wall of the upper body region of the box carton container.

Example B21 includes the scent delivery system of example B20, wherein the base surface is coupled to an outer surface of the outer wall, the base surface is coupled to an inner surface of the outer wall, or the base surface is coupled within the outer wall.

Example B22 includes the scent delivery system of example B20, wherein the outer wall includes two or more layers, and the base surface is coupled to the outer wall between two of the two or more layers.

In some embodiments in accordance with the present technology (example C1), a scent delivery system for a beverage contained in a box carton includes a box carton container to contain a fluid beverage, the box carton container including a main body region and an upper body region, the upper body region including a spout having an opening into the inside of the box carton container; a cap attachable to the spout of the box carton container to cover the opening, the cap operable to move, reversibly, between (i) a closed position that prevents the beverage contained within the box carton container to flow outward from the box carton container while the cap is attached to the box carton container and (ii) an open position that allows the beverage within the box carton container to flow outward while the cap is unattached to the box carton container; and a scented article coupled to the cap and operable to generate a scent capable of stimulating an olfactory sensation of a user including during consumption of the beverage when the cap is in the open position, wherein, when the cap is attached to the spout in the closed position, an interior surface of the cap and an external surface of the box carton container create a contact seal that encloses the scented article in a space within and locks in the scent.

Example C2 includes the scent delivery system of any of examples C1-C19, wherein the interior surface of the cap is a bottom surface of a side wall of the cap, and wherein the spout includes a base surface to which the bottom surface of the side wall of the cap contacts when the cap is attached to the spout in the closed position to create the contact seal.

Example C3 includes the scent delivery system of any of examples C1-C19, wherein the interior surface of the cap is an inner side surface of a side wall of the cap, wherein the spout includes a base surface and an adjacent base wall projecting upward from the base surface, and wherein the adjacent base wall is positioned on the base surface such that an outward side surface of the adjacent base wall contacts the inner side surface of the side wall of the cap when the cap is attached to the spout in the closed position to create the contact seal.

Example C4 includes the scent delivery system of any of examples C1-C19, wherein the interior surface of the cap is a bottom surface of a side wall of the cap, and wherein the spout includes a ridge indenting inward into a base surface of the spout, where the ridge is positioned on the base surface such that a surface of the ridge contacts the bottom surface of the side wall of the cap when the cap is attached to the spout in the closed position to create the contact seal.

Example C5 includes the scent delivery system of any of examples C1-C19, wherein the cap includes a ledge structure protruding inward from a side wall of the cap and configured to support the scented article above the ledge structure.

Example C6 includes the scent delivery system of example C5, wherein the ledge structure includes an annular radius that is less than a width dimension of the scented article so as to create a space below the scented article that is enclosed when the cap is attached to the spout in the closed position.

Example C7 includes the scent delivery system of example C6, wherein the interior surface of the cap includes a first interior surface that makes contact with the external surface of the box carton container when the cap is attached to the spout in the closed position and a second interior surface that makes contact with a side wall of the spout when the cap is attached to the spout in the closed position, wherein the cap includes a bridge structure that spans between the first interior surface and the second interior surface and is disposed above the ledge structure so that the scented article is between the ledge structure and the bridge structure, and such that the bridge structure is positioned within the cap to create a second space above the scented article that is enclosed when the cap is attached to the spout in the closed position.

Example C8 includes the scent delivery system of example C7, wherein space above the scented article and the space below the scented article enable the system to trap the scent emanated from the scented article so as to concentrate the scent when the cap is attached to the spout in the closed position.

Example C9 includes the scent delivery system of example C8, wherein the system is operable to release a concentrated scent when the cap is detached from the spout in the open position to facilitate a burst of the concentrated scent to the external environment around the spout.

Example C10 includes the scent delivery system of any of examples C1-C19, wherein the scented article includes one or more projections along at least one side surface of the scented article, and wherein the cap includes one or more cavities on an exterior side surface of the upper body region, such that the one or more projections of the scented article align with and fit within the one or more cavities of the cap to couple the scented article to the cap.

Example C11 includes the scent delivery system of example C10, wherein the scented article is reversibly attachable to the cap via coupling of the one or more projections and the one or more cavities.

Example C12 includes the scent delivery system of example C11, wherein the scented article is irreversibly attached to the cap via coupling of the one or more projections and the one or more cavities.

Example C13 includes the scent delivery system of any of examples C1-C19, wherein the scented article includes one or more cavities along at least one side surface of the scented article, and wherein the cap includes one or more protrusion structures on an exterior side surface of the upper body region, such that the one or more protrusion structures of the cap align with and fit within the one or more cavities of the scented article to couple the scented article to the cap.

Example C14 includes the scent delivery system of example C10, wherein the scented article is reversibly attachable to the cap via coupling of the one or more protrusion structures and the one or more cavities.

Example C15 includes the scent delivery system of example C11, wherein the scented article is irreversibly attached to the cap via coupling of the one or more protrusion structures and the one or more cavities.

Example C16 includes the scent delivery system of any of examples C1-C19, wherein the scent includes a volatile chemical agent loaded within at least a portion of the scented article.

Example C17 includes the scent delivery system of any of examples C1-C19, wherein the upper body region of the box carton container includes a triangular shape portion having a first side and a second side that span from two sides of the main body region and converge at an apex that forms a gable top of the box carton container, wherein the spout is positioned on the first side of the triangular shape portion of the upper body region.

Example C18 includes the scent delivery system of any of examples C1-C19, wherein the upper body region of the box carton container includes one or more side walls coupled to a top wall, wherein the spout is positioned on the top wall.

Example C19 includes the scent delivery system of any of examples C1-C18, wherein the box carton container is a paper-based box carton.

It is intended that the specification, together with the drawings, be considered exemplary only, where exemplary means an example. As used herein, the singular forms "a", "an" and "the" are intended to include the plural forms as well, unless the context clearly indicates otherwise. Additionally, the use of "or" is intended to include "and/or", unless the context clearly indicates otherwise.

While this patent document contains many specifics, these should not be construed as limitations on the scope of any invention or of what may be claimed, but rather as descriptions of features that may be specific to particular embodiments of particular inventions. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in this patent document should not be understood as requiring such separation in all embodiments.

Only a few implementations and examples are described and other implementations, enhancements and variations can be made based on what is described and illustrated in this patent document.

What is claimed is:

1. A scent delivery system for a beverage contained in a box carton container, comprising:

a box carton container to contain a fluid beverage, the box carton container including a main body region and an upper body region, the upper body region including a fitment protrusion having an opening into the inside of the box carton container;

a cap attachable to the fitment protrusion of the box carton container to cover the opening, the cap operable to move, reversibly, between a closed position that prevents the beverage contained within the box carton container to flow outward from the box carton container and an open position that allows the beverage within the box carton container to flow outward while the cap is attached to the box carton container; and a scented article that couples to the cap and operable to generate a scent capable of stimulating an olfactory sensation of a user including during consumption of the beverage when the cap is in the open position, wherein, when the cap is attached to the fitment protrusion in the closed position, an interior surface of the cap and an external surface of the box carton container create a contact seal that encloses the scented article in a space within and locks in the scent, wherein the fitment protrusion includes an adjacent base wall projecting upward from a base surface of the fitment protrusion, the adjacent base wall is positioned on the base surface such that an outer side surface of the adjacent base wall is able to contact an inner side surface of a side wall of the cap when the cap is attached to the fitment protrusion in the closed position, wherein an interface between the adjacent base wall and the side wall creates the contact seal.

2. The system of claim 1, wherein the box carton container is a paper-based box carton.

3. A scent delivery system for a beverage contained in a box carton, comprising:

a box carton container to contain a fluid beverage, the box carton container including a main body region and an upper body region, the upper body region including a spout having an opening into the inside of the box carton container;

a cap attachable to the spout of the box carton container to cover the opening, the cap operable to move, reversibly, between (i) a closed position that prevents the beverage contained within the box carton container to flow outward from the box carton container while the cap is attached to the box carton container and (ii) an open position that allows the beverage within the box carton container to flow outward while the cap is unattached to the box carton container; and a scented article coupled to the box carton container and operable to generate a scent capable of stimulating an olfactory sensation of a user including during consumption of the beverage when the cap is in the open position, wherein, when the cap is attached to the spout in the closed position, an interior surface of the cap and an external surface of the box carton container create a contact seal that encloses the scented article in a space within and locks in the scent, wherein the interior surface of the cap is a bottom surface of a side wall of the cap, and wherein the spout includes a ridge indenting inward into a base surface of the spout, where the ridge is positioned on the base surface such that a surface of the ridge contacts the bottom surface of the side wall of the cap when the cap is attached to the spout in the closed position to create the contact seal.

4. The system of claim 3, wherein the scented article is a scented ring that surrounds an outer wall of the spout.

5. The system of claim 3, wherein the scent includes a volatile chemical agent loaded within at least a portion of the scented article.

6. The system of claim 3, wherein the upper body region of the box carton container includes a triangular shape portion having a first side and a second side that span from two sides of the main body region and converge at an apex that forms a gable top of the box carton container, wherein the spout is positioned on the first side of the triangular shape portion of the upper body region.

7. The system of claim 3, wherein the upper body region of the box carton container includes one or more side walls coupled to a top wall, wherein the spout is positioned on the top wall.

8. The system of claim 3, wherein the box carton container is a paper-based box carton.

* * * * *